US011079115B1

(12) United States Patent
Wisener et al.

(10) Patent No.: US 11,079,115 B1
(45) Date of Patent: Aug. 3, 2021

(54) NON-ELECTRIC GRAVITY FEED PELLET STOVE

(71) Applicant: Independence Stove Company, LLC, Grants Pass, OR (US)

(72) Inventors: Gary L. Wisener, Brookings, OR (US); Gene R. Bradley, Wilderville, OR (US)

(73) Assignee: Independence Stove Company LLC, Grants Pass, OR (US)

( * ) Notice: Subject to any disclaimer, the term of this patent is extended or adjusted under 35 U.S.C. 154(b) by 0 days.

(21) Appl. No.: 17/160,360

(22) Filed: Jan. 27, 2021

Related U.S. Application Data

(60) Provisional application No. 63/132,483, filed on Dec. 31, 2020.

(51) Int. Cl.

| | |
|---|---|
| ***F24B 7/00*** | (2006.01) |
| ***F24B 1/02*** | (2006.01) |
| ***F24B 13/04*** | (2006.01) |
| ***F24B 7/04*** | (2006.01) |
| ***F24B 7/02*** | (2006.01) |
| ***F23B 50/02*** | (2006.01) |

(52) U.S. Cl.
CPC ..... *F24B 7/005* (2013.01); *F23B 50/02* (2013.01); *F24B 1/024* (2013.01); *F24B 7/02* (2013.01); *F24B 7/04* (2013.01); *F24B 13/04* (2013.01)

(58) Field of Classification Search
CPC .. F24B 7/005; F24B 13/04; F24B 7/02; F24B 7/04; F24B 1/024; F23B 50/02; F23N 1/007; F23G 2205/14; F23G 2205/16
See application file for complete search history.

(56) References Cited

U.S. PATENT DOCUMENTS

| | | | | | |
|---|---|---|---|---|---|
| 44,091 | A | | 9/1864 | Harrington | |
| 659,971 | A | | 10/1900 | Hower | |
| 1,012,013 | A | * | 12/1911 | Zhang et al. | B61D 17/043 105/418 |
| 1,808,487 | A | | 6/1931 | Ahlberg | |
| 2,229,555 | A | * | 1/1941 | Dartnell | F24B 1/08 126/10 |
| 4,366,802 | A | * | 1/1983 | Goodine | F23B 1/36 110/108 |
| 4,606,282 | A | | 8/1986 | Steindal | |
| 4,782,767 | A | | 11/1988 | Stoner | |
| 4,989,521 | A | * | 2/1991 | Traeger | F23B 1/38 110/102 |
| 5,137,010 | A | | 8/1992 | Whitfield et al. | |

(Continued)

*Primary Examiner* — David J Laux
(74) *Attorney, Agent, or Firm* — Richard A. Ryan

(57) ABSTRACT

A pellet stove to heat the interior of a structure and provide a heating surface for cooking. The pellet stove has a hopper storing pellet fuel, a core assembly inside a stove enclosure, a primary burn chamber assembly for burning pellet fuel and an air venting system. The hopper gravity feeds pellet fuel to the primary burn chamber assembly. The core assembly has a burn chamber housing connected to a flame chamber by a burn channel. The primary burn chamber assembly has a burn basket and a fuel control mechanism to control the amount of pellet fuel burned in the burn basket. The venting systems draws inlet air into and discharges exhaust air out of the pellet stove, which is sealed to prevent drawing inlet air from or discharging exhaust air to the structure interior. Fire in the flame chamber can be seen through an exterior glass panel.

20 Claims, 19 Drawing Sheets

(56) References Cited

U.S. PATENT DOCUMENTS

| | | | | |
|---|---|---|---|---|
| 5,357,877 | A | 10/1994 | Nuesmeyer et al. | |
| 5,893,358 | A | 4/1999 | Whitfield | |
| 5,983,885 | A | 11/1999 | Jarvi | |
| 6,223,737 | B1 | 5/2001 | Buckner | |
| 6,336,449 | B1 | 1/2002 | Drisdelle et al. | |
| 6,397,833 | B1 | 6/2002 | Jarvi | |
| 7,318,431 | B1 | 1/2008 | Holtan et al. | |
| 7,861,707 | B2 | 1/2011 | Wisener | |
| 2019/0383491 | A1* | 12/2019 | Hill | F23B 30/02 |

* cited by examiner

NON-ELECTRIC GRAVITY FEED PELLET STOVE

CROSS-REFERENCE TO RELATED APPLICATIONS

This patent application claims priority to U.S. Provisional Patent Application Ser. No. 63/132,483 filed Dec. 31, 2020.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to wood burning stoves and like heating systems utilized for heating the interior of a structure, including homes and offices, and for cooking food and heating liquids. In particular, the present invention relates to such wood burning stoves that are configured to efficiently and effectively burn pellets, granules and the like using gravity feed and natural draft intake systems to provide fuel and air to the burner. Even more particularly, the present invention relates to wood burning stoves that are configured to reduce or prevent issues with regard to smoke spillage into and negative pressure in the interior of a structure.

B. Background

The high cost of heating the interior of a building and cooking food and heating liquid using conventional, but non-renewable heating fuel sources, such as coal, heating oil, propane and the like, has led many people utilize wood burning fireplaces and stoves as the heat source, particularly for homes, shops and small offices. The basic configuration of typical wood burning fireplace and stove heating systems has been in use for very many years and has not significantly changed. One of the major disadvantages of standard wood burning fireplaces and stoves is that they are known to be a relatively inefficient means of converting the fuel, such as wood logs, into heat. In addition, standard wood burning fireplaces and stoves are also known to be significant contributors to air pollution. In fact, due to air pollution concerns, many municipalities and counties ban or substantially limit the use of wood burning fireplaces and stoves, particularly on days when the air quality of the region is such that the environment is unable to safely handle additional emissions from wood burning fireplaces and stoves.

A relatively recent improvement to stove-type heating systems is the pellet burning stove. As well known by those skilled in the art, pellet burning stoves have a number of substantial benefits over the typical wood (i.e., log) burning stove or fireplace, including more efficient burning of the fuel material, less emissions and cleaner emissions. Because of these benefits and benefits with regard to fuel availability, pellet burning stoves have come into wide use. Pellet stoves typically utilize wood pellets that are made of, at least in part, by-products from wood and lumber industries, including limbs, leaves and other tree waste materials, that are ground, processed and compressed into relatively small pellet-sized fuel material which are typically held together by resin or a resin-like material. In addition to the obvious benefit of more efficiently utilizing tree and wood by-products, wood pellets are somewhat easier to handle and store than conventional wood logs and the like. Other biomass materials are also known to be utilized for stove pellets. A known disadvantage of pellet fuel, in part due to the resin or other binding material utilized to hold the pellets together, is that it can be somewhat difficult to ignite and require relative high operating temperature for proper or complete combustion of the pellets.

To maintain the temperature required for sustained combustion of the pellet fuel, some pellet stoves utilize electric motor-powered fans or blowers to direct air into the stove's combustion chamber. Some pellet stoves also utilize electrically powered pellet delivery systems, for instance comprising an electric motor-driven auger or the like, to direct the pellets into the combustion chamber. As is well known in the industry, the use of electrically powered fans, blowers and pellet delivery systems significantly increase the initial cost, operating cost and complexity of the pellet stove, while providing a less than desirable overall fuel efficiency. In addition, these components are known to have mechanical problems, thereby reducing the reliability of such pellet stoves as a source of heat. The reliability problems of pellet stoves having electrically powered components are compounded when the electrical supply is interrupted due to inclement weather, as happens from time to time due to freezing rain, blizzards or the like, resulting in the pellet stove not being useable when it is most needed. As a result of these known disadvantages, the preferred pellet stoves are those that do not require electrically operated components for combustion or fuel delivery.

A number of heating and pellet stoves, and components therefore, have been patented. For instance, U.S. Pat. No. 659,971 to Hower describes a heating stove having a gravity fed combustion chamber that receives fuel from the fuel magazine onto a fire plate that receives draft air from a damper controlled vertical air pipe. U.S. Pat. No. 1,808,487 to Ahlber describes a heating stove or furnace having a gravity fed magazine tube that deposits fuel onto grate bars in the fire box, which receives air from a vent located to the side and below the fire box. U.S. Pat. No. 4,606,282 to Steindal describes a self-feeding wood burning stove configured to automatically feed and burn elongated, round cross-section logs. U.S. Pat. No. 4,989,521 to Traeger, et al. describes a gravity fed pellet burner stove having a hopper that gravity feeds fuel onto an inclined, channel-shaped chute, having holes thereon for air to flow through the fuel, in the burner. An adjustable opening controls the amount of air flowing through the burner.

In an attempt to improve the heating and fuel consumption efficiency of wood burning or pellet stoves, a number of patents describe heating systems that utilize mechanical fuel delivery and forced air apparatuses to deliver fuel and air into the burning chamber. For instance, U.S. Pat. No. 5,893,358 to Whitfield describes a pellet fuel burner having an auger that pushes fuel through a feed conduit onto a burner grate in the firebox, where combustion air is received from a blower through an air manifold. The feed conduit vertically deposits the fuel onto the burner grate. U.S. Pat. No. 6,223,737 to Buckner describes a fuel burning device, configured as a cooking grill, that utilizes an auger to deliver fuel from the hopper to the burner and a blower to provide air for combustion. U.S. Pat. No. 6,336,449 to Drisdelle, et al. describes a solid fuel burner that receives fuel from a hopper by an auger-driven apparatus. Air for the combustion in the burner is provided through a tube and discharged from the burner through a vent by use of an air discharge fan.

Improved natural draft, automatic feed pellet stoves are disclosed in U.S. Pat. Nos. 5,983,885 and 6,397,833 to Jarvi. The stove in these patents stores pellet fuel in a hopper having a discharge slot disposed above one end of a sloped grate. Air for the combustion process is provided to the underside of the grate through an air intake or draft pipe, having a damper thereon, that naturally draws in air from an air inlet. The pellets are discharged from the slot onto one end of the sloped grate so that combustion of the fuel takes place as the pellets roll over the grate. Ash from the combustion falls through the grate onto an ash collection pan at the bottom of the firebox.

An improved pellet stove that utilizes gravity feed and natural draft to more effectively and efficiently burn pellet fuel while producing less air pollution and ash is described in U.S. Pat. No. 7,861,707 to Wisener (who is also one of the present inventors). In one embodiment, the pellet stove has a primary combustion area comprising a burn unit removably disposed in the stove's vent tube, a feed tube which defines a fuel chamber located above the burn unit and a secondary combustion area, comprising a burn box, which defines a secondary burn chamber located below the burn unit. The burn unit has a removable receptacle that defines a primary burn chamber which receives pellet fuel from the fuel chamber and discharges substantially burned fuel to the secondary burn chamber for additional burning. Openings in the burn box, pellet receptacle and vent tube draw air into the burn chambers. A control mechanism controls air flow to regulate the heat generated by the pellet stove.

Common problems with presently available wood burning stoves and heaters that are utilized in a room or other interior area of a structure, including pellet stoves and heaters, relates to smoke spillage into and negative air pressure in the interior of the structure. Smoke spillage, also referred to as backpuffing, occurs when smoke from a wood burning stove or heater flows into a room or other interior of a structure instead of out of the structure through the chimney, which may be an exhaust pipe, associated with the stove or heater. One of the basic causes of smoke spillage, which can occur when a person is trying to light the fire or when he or she opens the door or other closure to tend to the fire, is a lack of positive (i.e., upward) draft in the chimney to pull smoke up the chimney and out the structure. Although the lack of the positive draft can be caused by a number issues that are not related to the design or installation of the wood burning stove or heater itself, such as a blocked chimney or the like, the spillage of smoke into the interior of a building can be a result of or at least contributed to by the normal use of a particular stove or heater. Naturally, smoke spillage into a structure is not a desirable operation of a stove or heater. Negative air pressure results when there is more air going out of a structure than is coming into the structure, a phenomena that is somewhat more prevalent with modern, energy efficient homes that were built or modified to be, at least effectively, airtight. The negative air pressure will attempt to pull air down the chimney rather than allow air from the inside the structure to flow through the stove or heater and up the chimney. Although negative air pressure can be eliminated by equalizing the ventilation into the structure, such as by opening windows and/or doors, to allow equal amounts of fresh, make-up air (also taking into account all the various vents, fans and the like discharging air) to reenter the structure, such air balancing is not always possible or practical. For a wood burning stove or heater, the negative air pressure can be solved by providing an air duct through a wall, floor or ceiling of the structure that is connected directly to the stove or heater in order to provide fresh, outside air to the combustion chamber of the stove or heater.

As generally well known in the art, a well designed stove, heater or combination thereof should allow the user to easily light the fire and quickly build up draft in the chimney that feeds the fire and draws smoke upward, not have any smoke spillage when trying to light the fire or while tending to the fire, and prevent foul odors or cold air from flowing into a structure when the stove/heater is not in use. Although some wood burning units are sold as either a stove or a heater, most people prefer that they can utilize their unit for both cooking food or warming liquids and heating the interior of the room or structure where the stove/heater is located. In addition, although there are many benefits to utilizing a wood burning stove, in particular a pellet burning stove or heater, many presently available wood burning stoves and/or heaters are not configured to allow a person to visualize a fire burning in the stove/heater when the door to the stove/heater is closed. As generally well known, many people who appreciate the benefits of having a wood burning stove/heater also want to enjoy the visual effect that is provided by being able to see a burning fire.

Although the various patents set forth above describe stoves and heaters that are configured to burn pellet fuel, there exists a need for an improved pellet stove that is efficient at burning pellet fuel to heat the interior of a structure that also provides the other benefits which are described above. More specifically, what is needed is an improved pellet stove that can also be utilized for cooking and which solves the problems with regard to smoke spillage, negative air pressure and lack of being able to see the fire. The improved pellet stove/heater should utilize natural draft air and a gravity feed system that feeds pellets to the burn chamber to eliminate the need for electric blowers and the like to provide combustion air to the stove/heater and the necessity of augers or other electrically operated fuel delivery apparatuses. A preferred gravity feed, natural draft pellet stove should effectively and efficiently burn the pellet fuel so as to substantially minimize the amount of particulate matter and other harmful matter in its exhaust emission. In addition to reducing air pollution emissions, the preferred pellet stove will more efficiently provide heat to the interior of the building relative to the amount of fuel consumed by the stove. In addition to the foregoing benefits, an improved pellet stove should prevent smoke spillage into the interior of the structure the stove is heating and not cause or contribute to negative air pressure inside the structure. The new stove should be able to be configured to allow the user to be able to see a fire so he or she can have the visual benefits thereof. The preferred pellet stove should be able to accomplish the above and be relatively inexpensive to manufacture, simple to operate and comprise few moving components so as to reduce the likelihood of mechanical breakdown.

SUMMARY OF THE INVENTION

The following presents a simplified summary of the disclosure of the present invention in order to provide a basic understanding of the invention to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The use of terms such as "including", "comprising" or "having" and variations thereof herein is meant to encompass the items listed thereafter and equivalents thereof. The terms "a" and "an" herein do not denote a limitation of quantity, but rather denote the presence of at least one of the referenced items. Further, the use of terms "first", "second", and "third", and the like, herein do not denote any order, quantity, or importance, but rather are used to distinguish one element or feature of an element from another. The term "and/or," when used herein with a list of two or more items, means that any one of the listed items can be employed by itself, or any combination of two or more of the listed items can be employed.

The new non-electric gravity feed pellet stove of the present invention provides the benefits and solves the problems identified above. That is to say, the present invention is directed to a new and improved pellet stove that efficiently burns pellet fuel to heat the interior of structure while also providing the other benefits which are described above. More specifically, the present invention is directed to a new and improved pellet stove that is structured and arranged to utilize natural draft air for fuel combustion and gravity to feed the pellet fuel to a combustion chamber while efficiently utilizing the wood pellets to provide heat for heating the interior a structure and cooking food and warming liquids. The natural draft and gravity feed pellet delivery system eliminate the need for electrically powered blowers and pellet feed delivery mechanisms. The new pellet stove of the present invention effectively and efficiently burns the pellet fuel in a manner which nearly eliminates or at least substantially reduces the amount of particulate matter and other harmful emissions from the stove while efficiently burning the pellet fuel to provide the heat desired by the user of the new stove. The pellet stove of the present invention is able to accomplish the above while preventing smoke spillage into the interior of the structure the stove is heating and not causing or contributing to negative air pressure inside the structure. The new pellet stove can be configured with a glass door that allows the user to visualize a fire so as to provide the ambient and other benefits thereof. In the preferred configurations of the present invention, the new pellet stove is relatively inexpensive to manufacture, simple to operate and comprises few moving components.

The new pellet stove of the present invention is sized and configured to fit on most fireplace hearths in front of a fireplace and vent through the existing fireplace box and chimney using, as an example, a four inch pellet vent or single wall flexible chimney component. As a freestanding model, the new pellet stove can be rear vented through and exiting wall or straight up through the ceiling and out the roof by simply reversing a flue plate on the pellet stove to allow for either use. The pellet stove of the present invention has a large cooktop area above a large glass panel viewing area of a flame chamber that allows for cooking food or heating water. The pellet stove has three access doors, including a first door in front of the flame chamber that allows users to see a vibrant and aesthetically, visually pleasing fire in the flame chamber. The second solid and sealed door is positioned in front of a combustion chamber (i.e., a burn chamber) to allow the user to access a fuel control mechanism so he or she can adjust the amount of pellet fuel allowed inside a burn basket inside the burn chamber of the pellet stove to regulate the burn temperature and burn duration of the pellet fuel. The fuel control mechanism has a operative lever that engages one of a plurality of notches to regulate how much pellet fuel can be received in the burn basket at any given time, which controls how much pellet fuel is burned in the burn chamber. The second door also allows the user to access an ash pan for ash removal, a lighting tube for lighting the pellet fuel in the primary burn chamber assembly and the components in the burn chamber for maintenance of the pellet stove. The third door, which is also a solid, sealed door, is located on the right hand side of the pellet stove and is also designed for easy access to the burn chamber for ease of lighting the pellet fuel, cleaning ash from the ash pan and/or maintenance of the pellet stove. The pellet fuel is lit by use of a hand-held propane torch or by utilizing a hand-held air heat gun that is designed to light solid fuel appliances and barbeques. The pellet stove can also be lit using a solid fuel igniter or liquid gel. In one embodiment of the present invention, the new pellet stove has a large hopper that is capable of holding approximately eighty pounds of pellet fuel. The hopper has a latching system and a gasket or other sealing mechanism that are configured to prevent air leakage into or out of the pellet stove via the hopper. The hopper has a slidable adjustment mechanism that opens or closes a fuel discharge opening at the bottom of the hopper assembly to close off pellet fuel delivery to the primary burn chamber assembly to cause the fire in the stove to go out (i.e., stop burning).

In one of the preferred embodiments of the present invention, the new gravity feed pellet stove for use in the interior of a home or other structure generally comprises a sealed stove enclosure, a sealed hopper assembly that is sealably connected to the stove enclosure, a core assembly inside the stove enclosure, a primary burn chamber assembly for burning pellet fuel and a venting system for drawing in inlet air to and discharging exhaust air from the primary burn chamber assembly. The stove enclosure has one or more walls, typically a plurality of walls, that define an interior area of the pellet stove. The hopper assembly has a hopper with one or more hopper walls that define a pellet storage chamber for storing a quantity of pellet fuel. The hopper has a fuel discharge opening associated therewith for directing pellet fuel downward below the hopper. The hopper is structured and arranged so it will gravity feed pellet fuel from the pellet storage chamber through the fuel discharge opening thereof to the primary burn chamber assembly. The core assembly, which is located inside the interior area of the stove enclosure, has a burn chamber housing that is positioned below the fuel discharge opening of the hopper, a primary burn channel which is connected in fluid flow communication with the burn chamber, and a flame chamber that is connected in fluid flow communication with the primary burn channel so as to pneumatically connect the flame chamber to the burn chamber to allow fire (flames), heated air and exhaust air to flow from the burn chamber to the flame chamber.

The primary burn chamber assembly is associated with the burn chamber housing in the interior area of the stove enclosure for burning pellet fuel that is received, by gravity feed, from the hopper. The portion of the interior area of the stove enclosure having the burn chamber housing functions as the combustion chamber of the new pellet stove. In a preferred configuration, the primary burn chamber assembly has a primary burn chamber, a burn basket associated with the primary burn chamber and a fuel control mechanism operatively associated with the primary burn chamber and the burn basket. The burn basket is sized and configured to receive pellet fuel from the fuel discharge opening of the hopper. The fuel control mechanism is structured and arranged to control the amount of pellet fuel that is received in the burn basket in order to control the amount of pellet fuel which is burned in the primary burn chamber assembly, which controls the amount of heat produced by the pellet stove. The venting system has an inlet tube that is associated with the stove enclosure to draw inlet air into the primary burn chamber assembly for combustion of the pellet fuel in the burn basket and to discharge exhaust air from the flame chamber and out of the pellet stove through an exhaust tube associated with the stove enclosure. The air flow in and out of the pellet stove is accomplished by a positive natural draft effect. The pellet stove is sealably configured such that after the pellet fuel is lit in the burn basket, the inlet air is drawn through the inlet tube to the burn basket to produce a fire therein which produces fire/flames, heated air and the exhaust air from the burning pellet fuel that flows through the primary burn channel to the flame chamber to produce heat at the walls of the enclosure that directs heat into the interior of the structure and discharges the exhaust air out of the pellet stove through the exhaust tube without drawing inlet air from the interior of the structure or discharging exhaust air into the interior of the structure.

In the preferred embodiments of the present invention, the pellet stove is utilized for both heating the interior of a structure and for cooking food and/or warming liquids (in a pot or other separate container). To accomplish this aspect of the invention, the pellet stove further comprises a hot plate that is associated with the flame chamber and a top wall of the stove enclosure. The hot plate of the pellet stove is positioned and configured to be heated by the fire and the heated air from the flame chamber in a manner which defines a heating surface on an upper surface of the top wall of the stove enclosure that can be utilized for cooking food and/or heating liquids. In a preferred configuration, the hot plate is positioned above the flame chamber and at least substantially adjacent, if not in abutting relation to, a lower surface of the top wall of the stove enclosure.

The burn basket and the fuel control mechanism of the primary burn chamber assembly are cooperatively structured and arranged to allow the user to, by utilizing the fuel control mechanism, adjust the amount of pellet fuel that can be held, and therefore burned, in the burn basket. As such, by controlling how much pellet fuel is received in the burn basket, the user is able to control how much pellet fuel is burned and, as a result, how much heat is produced by the pellet stove for heating or cooking. In one of the preferred configurations, the primary burn chamber has a chamber support having a face plate that is attached thereto or integral to the chamber support and the fuel control mechanism has a control lever and at least one notch on or otherwise associated the face plate of the chamber support. The notch(es) is/are structured and arranged to be engaged by the user moving the control lever into position at a notch to reduce or increase the capacity of the burn basket for holding pellet fuel. Preferably, the face plate has a plurality of notches on at least one edge of the face plate. The burn basket has a plurality of upwardly disposed generally U-shaped holding bars in spaced apart relation to each other so as to define a plurality of gaps between adjacent pairs of the holding bars and a pivot bar that is disposed through at least one of the gaps. In this configuration, the fuel control mechanism has a plurality of spaced apart control arms, a pivot rod connected to at least one of the control arms and a control lever connected to the pivot rod, with the control arms being moveably disposed in the gaps between the holding bars. The control arms have a proximal end that is connected to the pivot bar and a distal end which is pivotally connected to the pivot bar in a manner which allows the control arms to pivot relative to the holding bars to reduce or increase the capacity of the burn basket for holding the pellet fuel that will be burned to produce the fire/heat that is used for heating or cooking.

In a preferred configuration, the fuel control mechanism comprises a control lever and a plurality of notches that are associated with the primary burn chamber, with each one of the notches being structured and arranged to be engaged by the control lever in a manner which prevents uncontrolled movement of the control lever. The fuel control mechanism is operated by movement of the control lever and engagement thereof with one of the plurality of notches to reduce or increase the capacity of the burn basket for holding pellet fuel to control the amount of fuel that is burned in the primary burn chamber assembly. The burn basket is supportedly positioned inside the primary burn chamber, which has an aperture with a lighting tube extending outward from the primary burn chamber. The lighting tube is open to the burn basket through the aperture and is sized and configured for lighting the pellet fuel in the burn basket through a closeable opening in at least one wall of the stove enclosure, such as a door on one of the sidewalls of the stove enclosure.

The core assembly is sized and configured to allow the flame from the burn basket to extend into the flame chamber. In the preferred embodiment, the stove enclosure has a glass panel which is positionally associated with the flame chamber. More specifically, the glass panel is positioned on the stove enclosure and sized and configured to allow viewing of the fire in the flame chamber through the glass panel. In a preferred embodiment, the glass panel is associated with a sealable door that is located at a front wall of the stove enclosure.

Typically, the pellet stove of the present invention also has an inlet pipe that is sealably connected to or integral with the inlet tube to draw in the inlet air which is utilized for combustion from outside the structure, an outlet pipe that is sealably connected to or integral with the exhaust tube to discharge the exhaust air from the pellet stove to outside the structure and a plurality of sealing mechanisms that are sized and configured to seal the pellet stove. In this manner, the venting system and the various sealing mechanism are able to prevent the inlet air being drawn into the pellet stove from the interior of the structure, which could cause negative air pressure inside the structure, and to prevent exhaust air from the pellet stove being discharged to the interior of the structure as smoke spillage or the like. The inlet pipe and exhaust pipe can extend into a nearby fireplace (i.e., if the pellet stove is placed in the hearth thereof) and/or through a wall or roof of the structure in which the pellet stove is utilized.

Accordingly, the primary object of the present invention is to provide a new gravity feed, natural draft pellet stove that has the advantages which are set forth above and that overcomes the various disadvantages and limitations which are generally associated with presently available pellet stoves.

An important objective of the present invention is to provide a pellet stove that relies on natural draft to supply the air which is necessary for efficient and effective combustion of the pellet fuel and a gravity feed system for delivering pellet fuel to the burn chamber so as to eliminate the need for electrically-driven blowers, augers and like devices to provide combustion air and to deliver the pellet fuel to the burn chamber.

It is also an important objective of the present invention to provide a new pellet stove that combines the features of gravity feed and natural draft while achieving virtually complete combustion of the pellet fuel so as to substantially reduce the amount of particulate or other harmful matter in the emissions exhausted from the pellet stove.

It is also an important objective of the present invention to provide a pellet stove that accomplishes the above objectives while efficiently heating the interior of a house, office or other structure while preventing smoke spillage into the interior of the structure and not causing or contributing to negative air pressure inside the structure.

An important aspect of the present invention is that it provides a new gravity feed, natural draft pellet stove which accomplishes the objectives set forth above and elsewhere in the present disclosure.

Another important aspect of the present invention is that it provides a new gravity feed, natural draft pellet stove which is specifically structured and arranged to eliminate the need for electrically-driven blowers, augers and like devices to provide combustion air for burning the pellet fuel and to deliver the pellet fuel to the burn chamber.

Another important aspect of the present invention is that it provides a new gravity feed, natural draft pellet stove which is specifically structured and arranged to efficiently and effectively burn the wood pellet fuel so as to achieve nearly complete combustion of the pellet fuel in order to substantially reduce the amount of particulate or other harmful matter in the emissions exhausted from the pellet stove so the stove can be used for heating and cooking in a cost effective and an environmentally friendly manner.

Another important aspect of the present invention is that it provides a new gravity feed, natural draft pellet stove which is specifically structured and arranged to prevent smoke spillage into the interior of the structure where the stove is being utilized and to not cause or contribute to negative air pressure inside the structure.

Another important aspect of the present invention is that it provides a new gravity feed, natural draft pellet stove which can be configured with a glass door that allows the user to visualize a fire so as to provide the ambient and other benefits thereof.

Yet another important aspect of the present invention is that it provides a new gravity feed, natural draft pellet stove which is relatively inexpensive to manufacture and simple to operate so as to be widely available for use and which comprises few moving components so as to reduce the likelihood of mechanical breakdowns requiring repair or replacement of such components.

As will be explained in greater detail by reference to the attached figures and the description of the preferred embodiments which follow, the above and other objects and aspects are accomplished or provided by the present invention. As set forth herein and which will be readily appreciated by persons who are skilled in the relevant art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
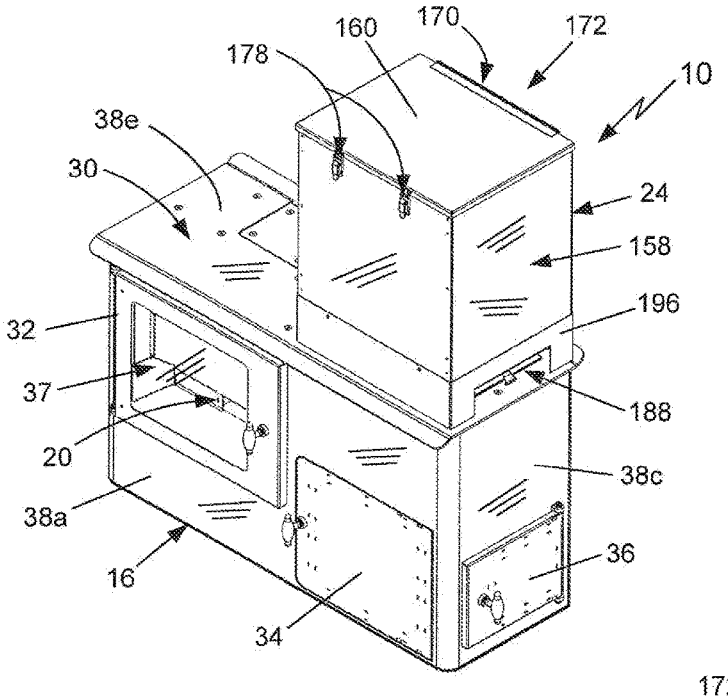
FIG. 1 is a front perspective view a pellet stove that is configured according to a preferred embodiment of the present invention particularly showing the fuel storage bin, the doors to the burn chamber and use of a glass door enclosing the core of the stove.
Figure 2:
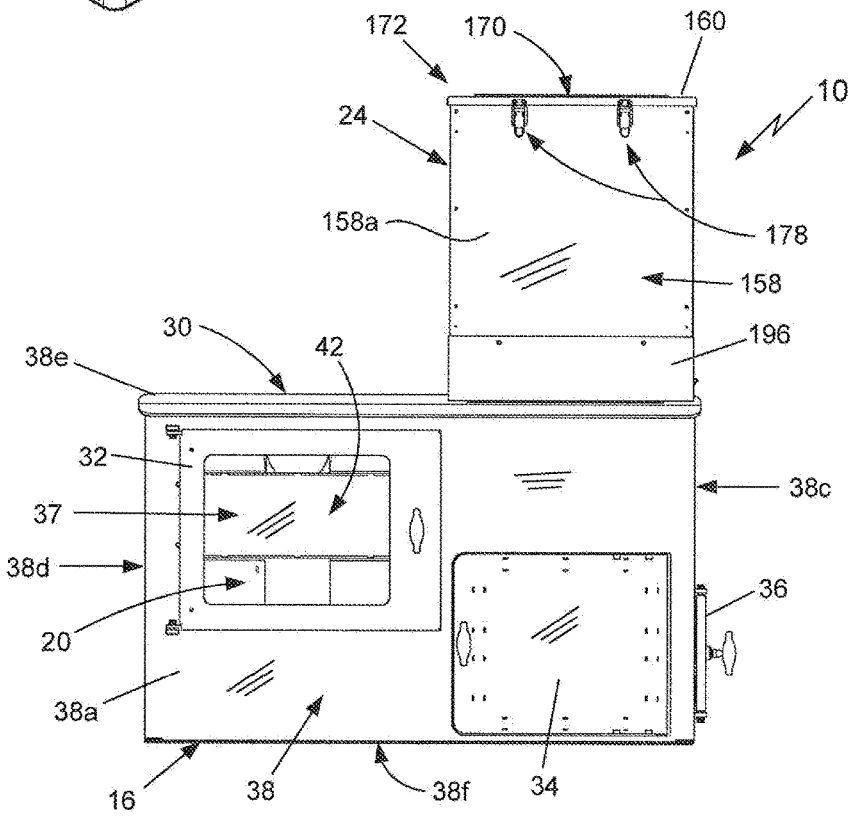
FIG. 2 is a front view of the pellet stove of FIG. 1.
Figure 3:
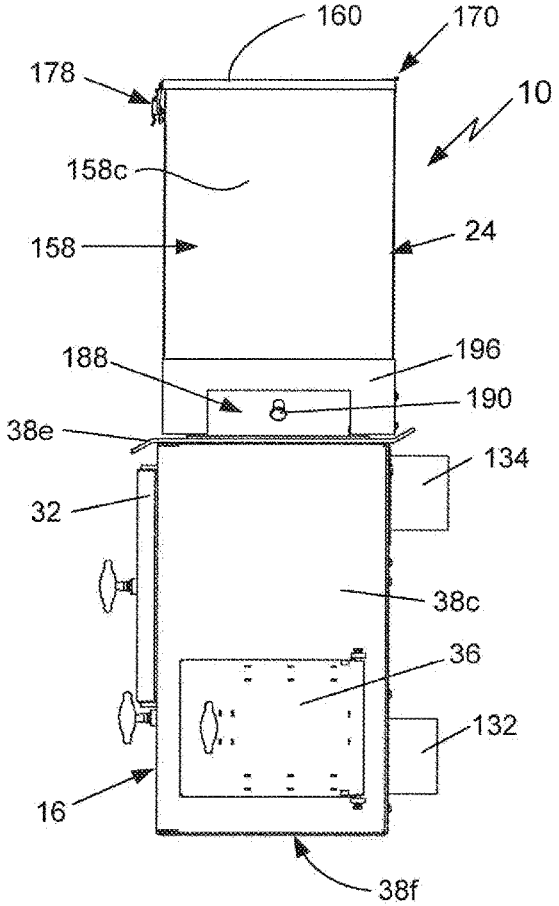
FIG. 3 is a right side view of the pellet stove of FIG. 1.
Figure 4:
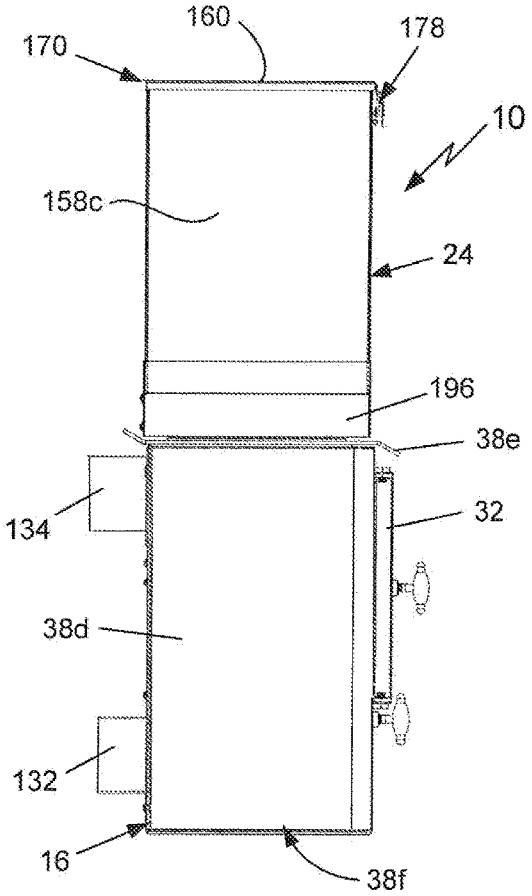
FIG. 4 is a left side view of the pellet stove of FIG. 1.
Figure 5:
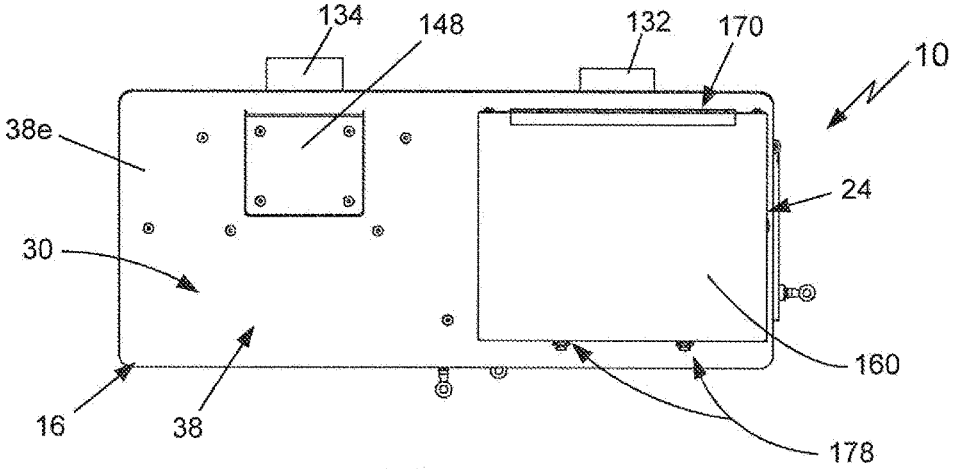
FIG. 5 is a top view of the pellet stove of FIG. 1.
Figure 6:
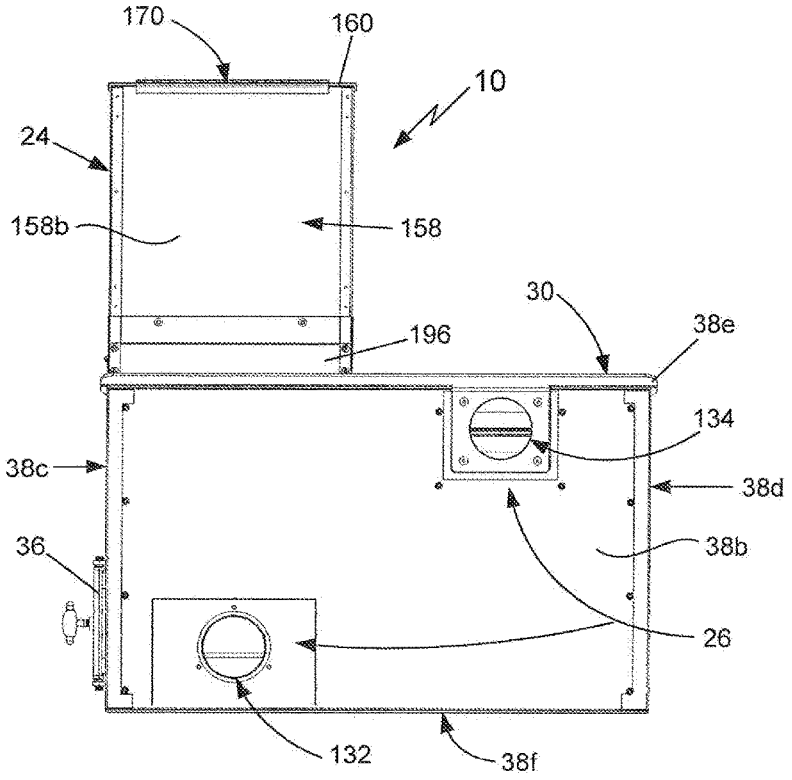
FIG. 6 is a back view of the pellet stove of FIG. 1.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular configurations for the non-electric gravity feed natural draft pellet stove of the present invention, persons who are skilled in the relevant art will readily appreciate that the present invention is not so limited. In addition, the exemplary embodiments of the present device are shown and described with only those components which are required to disclose the present invention. As a result, many of the necessary components for manufacturing and using the present invention are not shown in the drawings or necessarily described below, but which are well known to persons who are skilled in the relevant art. As will be readily appreciated by such persons, the various elements of the present invention that are described below may take on any form consistent with forms which are readily realized by one of ordinary skill in the art who have general knowledge of the configuration and use of pellet stoves and pellet fuel.

Figure 41:
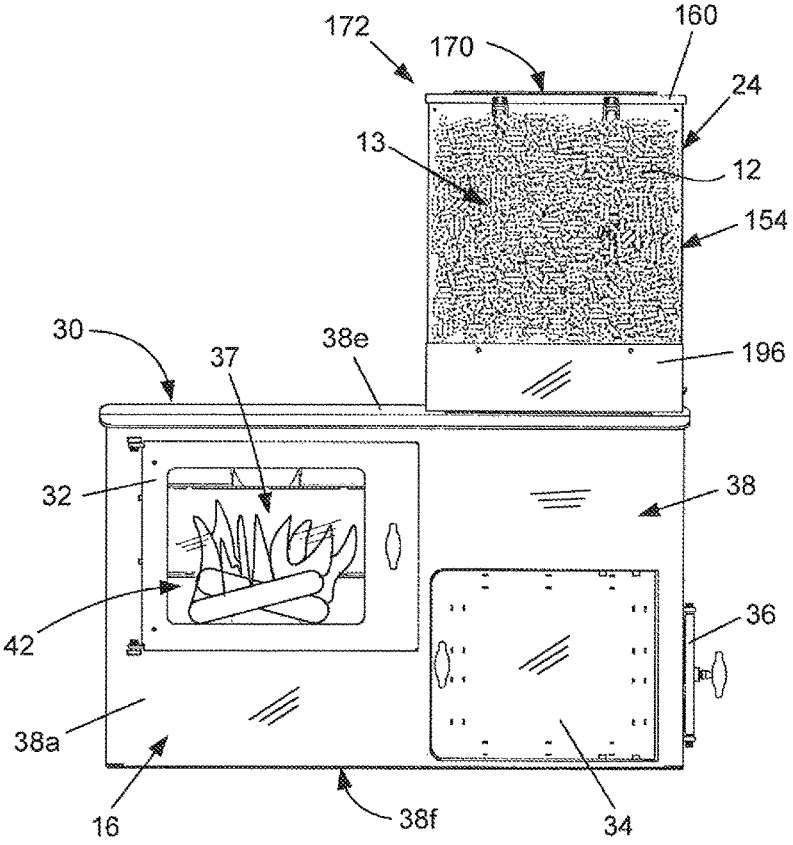
FIG. 41 is a front view of the pellet stove of FIG. 1 shown in use on the hearth of a fireplace with pellet fuel shown in the hopper and a fire and logs in the flame chamber.
Figure 42:
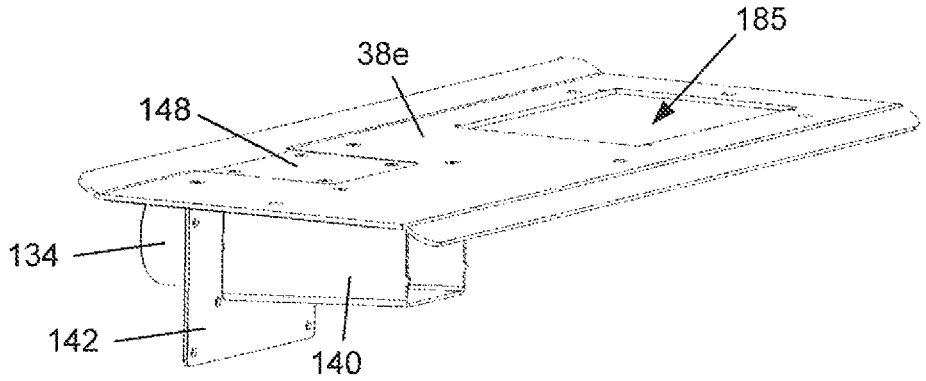
FIG. 42 is a left side perspective view of certain components of the pellet stove of FIG. 1, namely, the top wall, shim plate, exhaust channel, exhaust channel rear plate and exhaust tube thereof.

A new pellet stove that is configured pursuant to one of the preferred embodiments of the present invention is shown generally as 10 in FIGS. 1-6, 41 and 47. As shown in these figures and set forth in more detail below, the new pellet stove 10 of the present invention is structured and arranged to effectively and efficiently burn pellet fuel 12, from a stored quantity of pellet fuel 13, to heat the interior of a structure, to heat food and liquid and provide a visually perceivable fire 14, as shown in FIG. 41. For purposes of describing and using the pellet stove 10 of the present invention, the term "pellet fuel" is being utilized herein to refer to any type of fuel that is provided in pellet or pellet-like form and which can be burned to create a fire and to heat the interior of a structure in which the pellet stove 10 and to heat food and/or liquids, including but not limited to the standard pellet fuel that is commonly utilized in prior art pellet stoves. The pellet stove 10 accomplishes the various objectives set forth therein in a manner which substantially reduces pollution discharged to the environment from the pellet stove 10 relative to prior art pellet stoves. Because the burn and air supply systems are enclosed in a box-like enclosure, the new pellet stove 10 solves the problem of allowing air to enter a pellet stove from inside the structure, which adds to or creates negative air pressure problems in the structure, that is common with prior art pellet stoves. In addition, because the pellet stove 10 operates on a fuel level control basis rather than an air level control basis and eliminates burn issues with prior art pellet stove operations, the new pellet stove 10 prevents back burn into the pellet stove's fuel storage compartment and smoke spillage into the interior of the structure in which the pellet stove 10 is utilized. As also set forth below with regard to the preferred configurations of the new pellet stove 10, the pellet stove 10 provides a much larger aesthetic view of the fire 14 than is provided by prior art pellet stoves and has a much better overall appearance that users are more likely to prefer.

The new pellet stove 10 of the present invention is configured to be placed on most fireplace hearths in front of a fireplace and be utilized as either a fireplace insert or a freestanding stove that rear vents through an existing fireplace box and chimney or, by reversing a single component, through an existing wall or ceiling/roof to outside the structure in which the pellet stove 10 is utilized. The venting of the new pellet stove 10 can be achieved by using a four inch pellet vent or a single wall flexible chimney component. As set forth below, the new pellet stove 10 has a large, flat cooktop area for cooking food or heating liquids that is positioned above a flame chamber which is enclosed by a door having a glass window for viewing a vibrant and aesthetically pleasing fire 14. The pellet stove 10 has another door which provides the user access to adjust the amount of pellet fuel 22 in the primary burn area to regulate the burn temperature and burn duration of the pellet fuel 12 and to allow the user to light the pellet stove 10, remove ash and perform maintenance. Another door also provides the user further access to the primary burn area to help in lighting the pellet fuel 12 and in cleaning and/or maintaining the pellet stove 10.

For purposes of describing the use and relative location of the various components of the pellet stove 10 of the present invention and the use thereof, the terms "front", "forward", "forwardly" and the like are utilized to refer to the direction of the stove facing the user when he or she is facing the fire 14 of the pellet stove 10 in FIG. 41, the terms "back", "rear", "rearward", "rearwardly" and the like are utilized to refer to the direction of facing away from the user when he or she is facing the front of the pellet stove and the directions "left", "leftward", "right", "rightward" and the like refer to a direction that is to the left or right side of the pellet stove 10 when viewed from the perspective of a person while he or she is viewing the front of the pellet stove. Likewise, the various terms "upward", "upwardly", "upper", "top" and the terms "downward", "downwardly", "lower", "bottom" and the like refer to the direction of the components of the pellet stove 10 when the pellet stove 10 is in its upright position during normal use thereof, as best shown in FIGS. 1-6, 41 and 47.

As best shown in FIGS. 1-13, the new pellet stove 10 of the present invention generally comprises an outer, air-tight and sealed box or box-like stove enclosure 16 and an interior area 18 that is defined by the stove enclosure 16. In the interior area 18 of the stove enclosure 16 is a core assembly 20, a primary burn chamber assembly 22 that is associated with the core assembly for burning pellet fuel 12, a hopper assembly 24 that delivers (by gravity feed) the pellet fuel 12 to the primary burn chamber assembly 22, a venting system 26 that draws (by natural draft) air into the interior area 18 of the pellet stove 10 and discharges (also by natural draft) exhaust air out of the pellet stove 12, as shown in FIGS. 1-13, 41 and 45-46. In the preferred embodiments of the present invention, the new pellet stove 10 also has a hot plate 28 that provides a heating surface 30, as best shown in FIGS. 1-2, 5-7 and 10-18, for cooking food and/or heating liquids (in a container). As set forth above and best shown in FIGS. 1-3 and 12, the new pellet stove 10 has a plurality of sealed doors which allow the user to view and access the interior area 18, namely, a first door 32 that allows access to and visualization of the fire 14 in the area of the core assembly 20 under the top plate 28, a second door 34 which provides the user access to the primary burn chamber assembly 22 and a third door 36 which also provides access to the primary burn chamber assembly 22. In the preferred embodiments, the first door 32 has a glass panel 37 that allows the user to see the flames of the fire 14 located in the core assembly 20 so he or she may enjoy the aesthetics thereof, as shown in FIG. 41. Typically, the second door 34 and third door 36 are solid. The details of the configuration and use of the above components listed above are set forth in more detail below.

Figure 43:
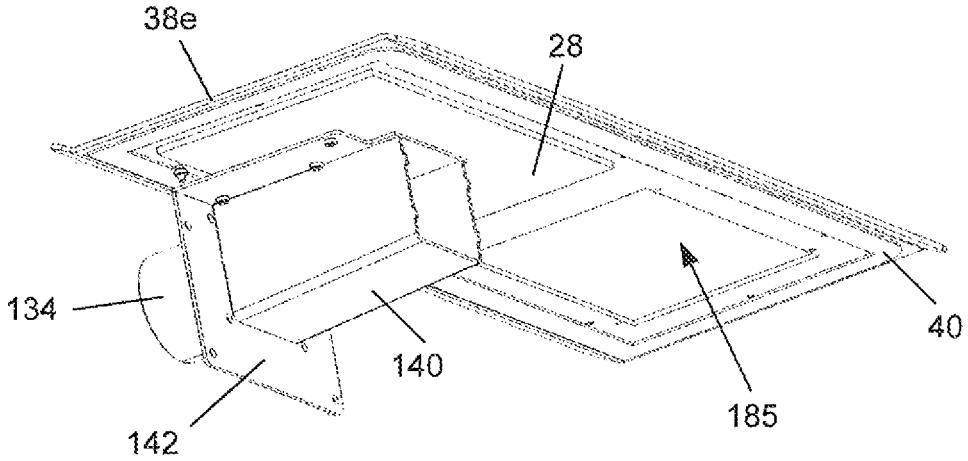
FIG. 43 is a bottom perspective view of the components of the pellet stove of FIG. 42 also showing the hot plate, top wall gasket and flue plate of the pellet stove.
Figure 44:
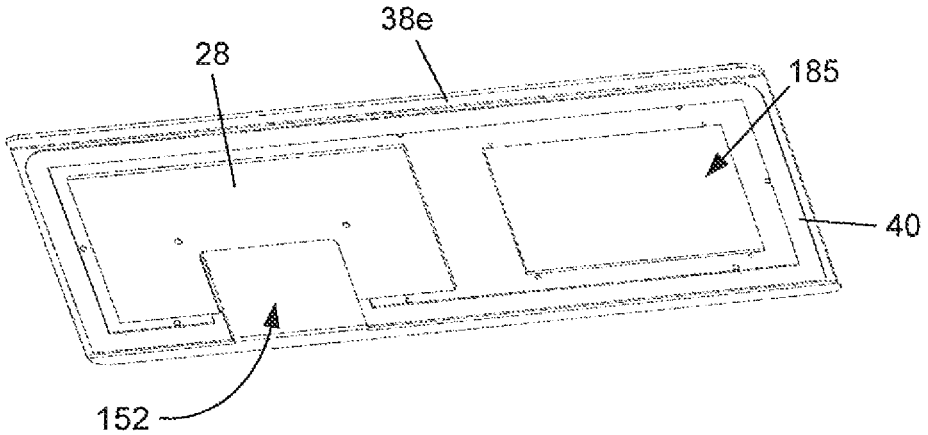
FIG. 44 is a bottom perspective view of the top wall, hot plate and top wall gasket of FIG. 43.

The stove enclosure 16 has a plurality of walls 38 comprising at least a front wall 38*a*, a back wall 38*b*, a right or first side wall 38*c*, a left or second side wall 38*d*, a top wall 38*e* and a bottom wall 38*f*, as best shown in FIGS. 1-4 and 6. In the preferred embodiments, the hot plate 28 is in abutting relation, as shown in FIGS. 43-44, to the top wall 38*e* just above the area behind the first door 32. The portion of the top wall 38*e* above the hot plate 28 defines the heating surface 30. The above components are joined together by welding or other means appropriate for the materials utilized for the walls 38 with a variety of gaskets or other sealing mechanisms, such as the top wall gasket 40 shown in FIGS. 43-44, being utilized to provide the air-tight sealed stove enclosure that will enclose the burning and venting components of the pellet stove 10 in a manner which provides the benefits of the pellet stove 10 with regard to not causing or adding to negative pressure issues in the structure where the pellet stove 10 is being utilized and not allowing smoke spillage into the structure. The various openings in the stove enclosure 16 associated with the hopper assembly 24, venting system 26 and doors 32/34/36 are also sealed, as appropriate, with gaskets or other sealing mechanisms to prevent the new pellet stove 10 drawing in air from inside the structure and/or allowing smoke spillage into the structure. The improved features of the new pellet stove 10 of the present invention allow the pellet stove 10 to meet stringent requirements with regard to certification for use of wood burning stoves in certain geographical areas and/or in certain structures, such as environmentally sensitive areas and modern air-tight homes, offices and other buildings and mobile homes or other manufactured housing.

As set forth above, the stove enclosure 16 is structured and arranged to define the interior area 18, as best shown in FIGS. 7-9 and 11. Located in the interior area is the core assembly 20, primary burn chamber assembly 22 and hot plate 28. As set forth in more detail below, components of the venting system 26 are in fluid flow communication with the interior area 18 of the stove enclosure 16. As shown in FIGS. 7-11, sealably connected to the interior area 18 of the stove enclosure 16 is the hopper assembly 24 so as to be able to deliver, via gravity feed, pellet fuel 12 to the components of the primary burn chamber assembly 22. The core assembly 20, which is best shown in FIGS. 14-20 (which also shows the hot plate 28), comprises a flame chamber 42 that is located behind the glass panel 37 of the first door 32, a burn chamber housing 44 that is located behind the second door 34 and third door 36 to receive the primary burn chamber assembly 22 and a primary burn channel 46 that interconnects the flame chamber 42 and the burn chamber housing 44 in fluid flow communication with each other. As shown FIGS. 14-20, the flame chamber 42 has an upper panel 48, a lower panel 50, a center panel 52, a first or right side panel 54, a second or left side panel 56 and a back panel 58 that, taken together, define an aesthetic fire area in which flames from the primary burn chamber assembly 22 produce the fire 14 which can be seen behind the glass panel 37 of the first door 32, as shown in FIG. 41 (which shows the use of one or more fake logs, such as made out of ceramic or the like, can be placed to add to the aesthetic benefits of a fire).

Figure 14:
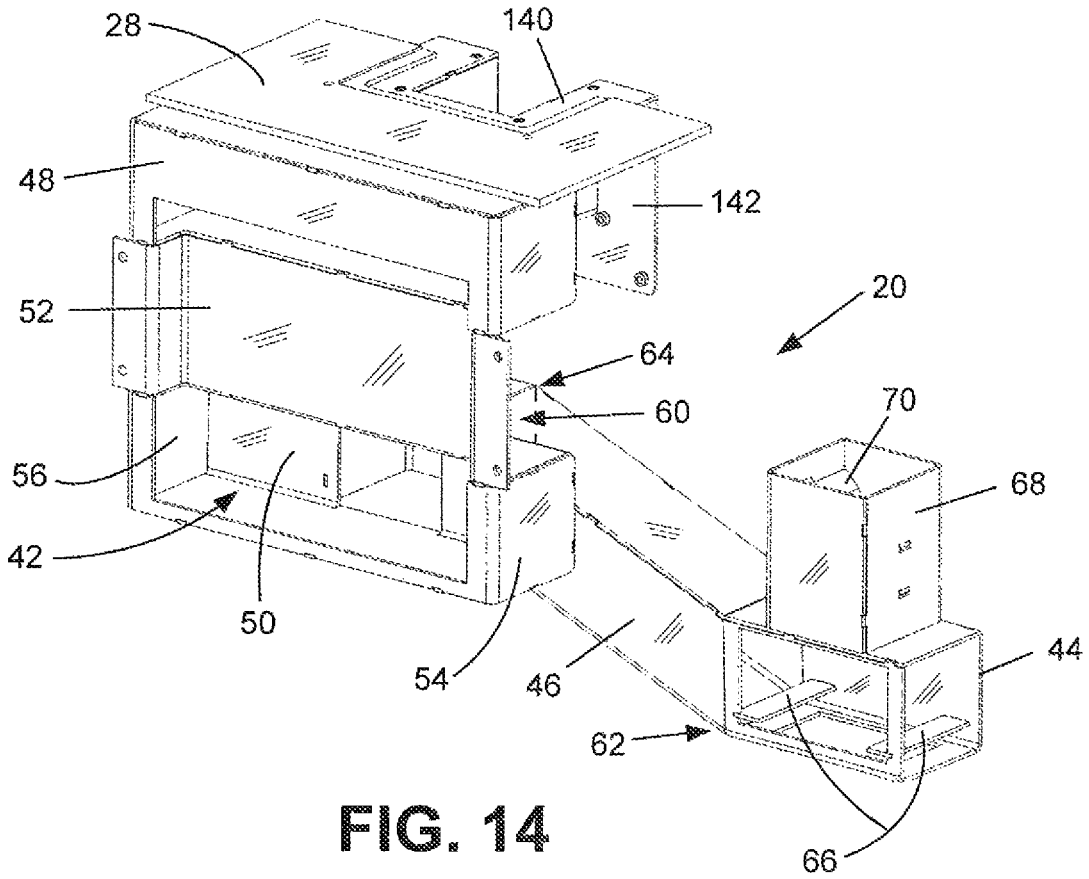
FIG. 14 is a front perspective view of the core assembly of the pellet stove of FIG. 1.
Figure 15:
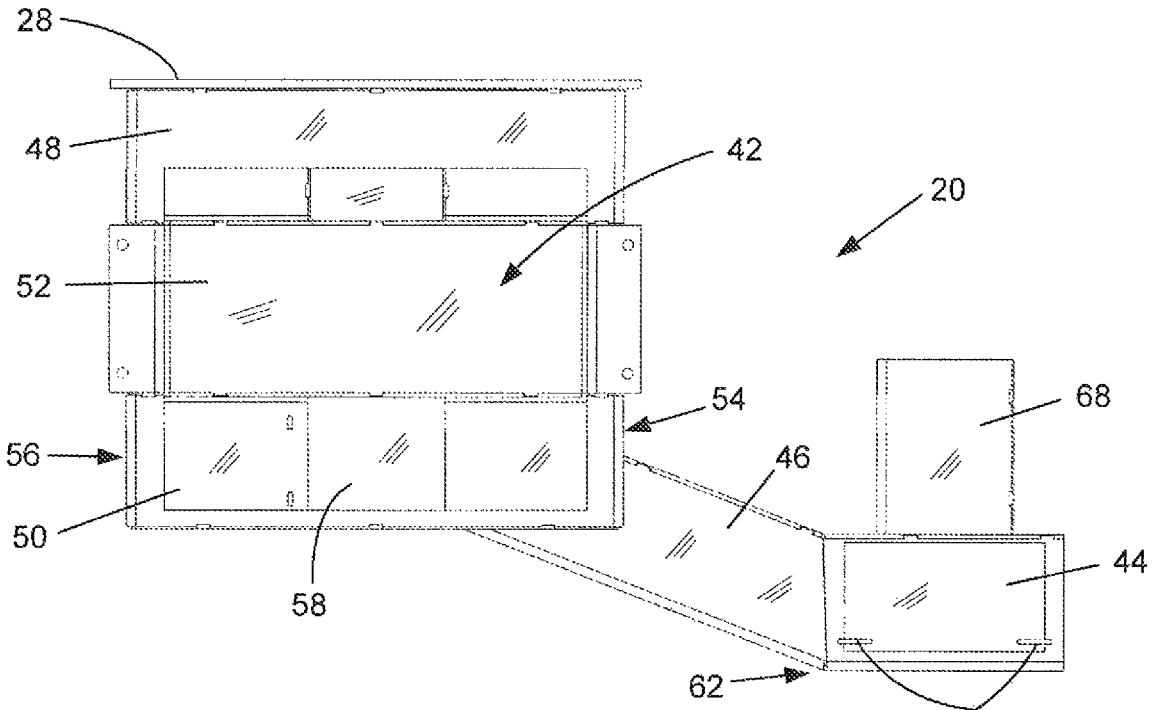
FIG. 15 is a front view of the core assembly of FIG. 14.
Figure 16:
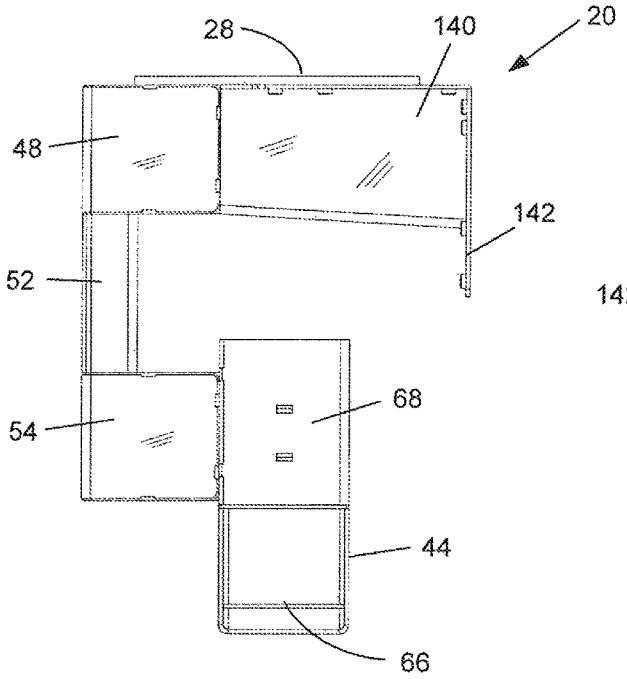
FIG. 16 is a right side view of the core assembly of FIG. 14.
Figure 17:
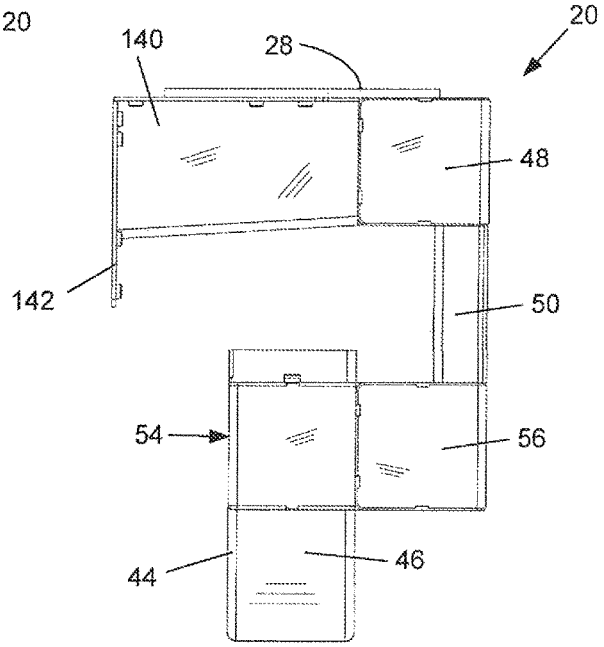
FIG. 17 is a left side view of the core assembly of FIG. 14.
Figure 19:
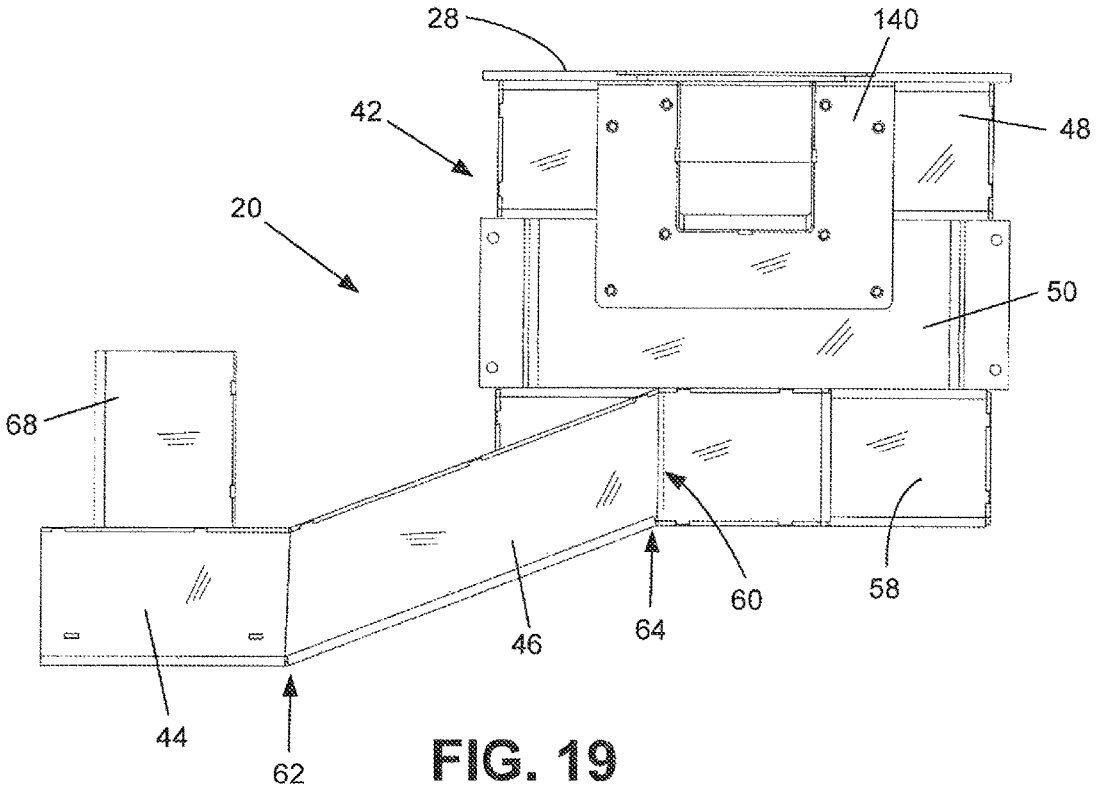
FIG. 19 is a back view of the core assembly of FIG. 14.
Figure 20:
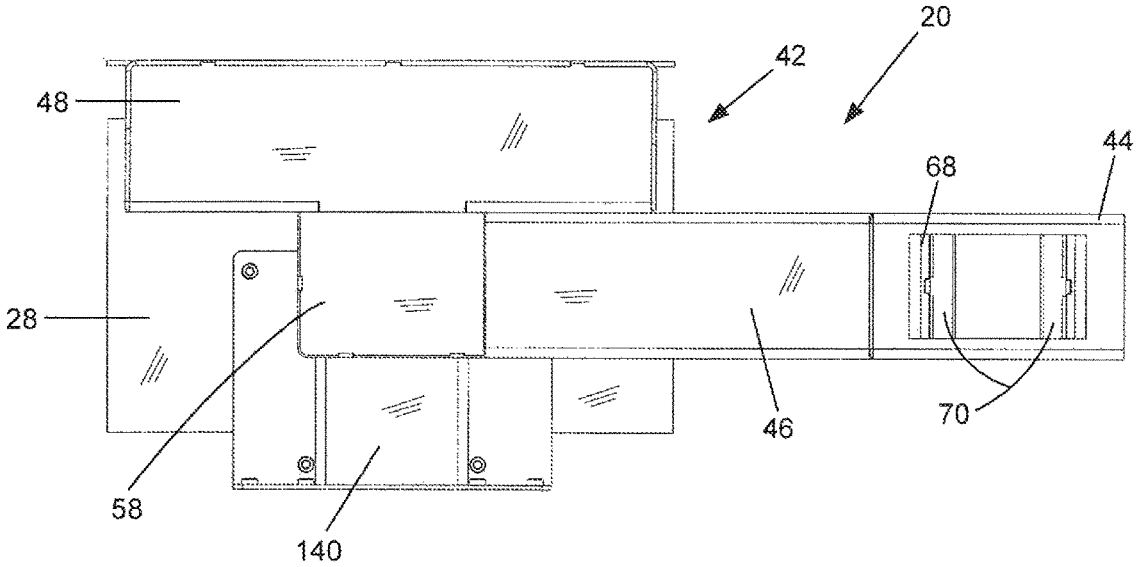
FIG. 20 is a bottom view of the core assembly of FIG. 14.

A flame chamber opening 60 located generally at the back of the flame chamber 42 connects the interior of the flame chamber 42 to the burn chamber housing 44 via an inclined primary burn channel 46, as best shown in FIGS. 14-15 and 19. More specifically, the inclined primary burn channel 46 has a first or lower end 62 connected to the burn chamber housing 44, as best shown in FIGS. 15 and 19, and a second or upper end 64 of the primary burn channel 46 is connected to the flame chamber opening 60 of the flame chamber 42, as best shown in FIGS. 14 and 19, to provide an enclosed heat, flame and air flow path between the primary burn chamber assembly 22 and flame chamber 42. As will be readily appreciated by persons skilled in the art, the primary burn channel 46 is tubular shaped and is sized and configured (i.e., inclined) to facilitate hot exhaust air and flames flowing upward from the primary burn chamber assembly 22 in the burn chamber housing 44 to the flame chamber 42. In the embodiment shown in the figures, the primary burn channel 46 has a generally square cross-section. The components of the core assembly 20 are made out of sheet metal, stainless steel and the like that are selected for their structural and heat transfer properties.

Figure 10:
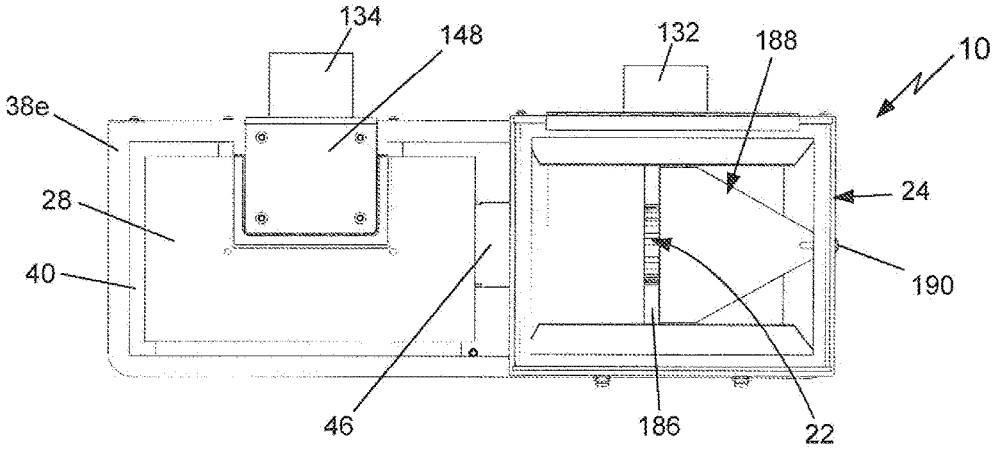
FIG. 10 is a top view of the pellet stove of FIG. 9 shown with the lid of the hopper removed.
Figure 11:
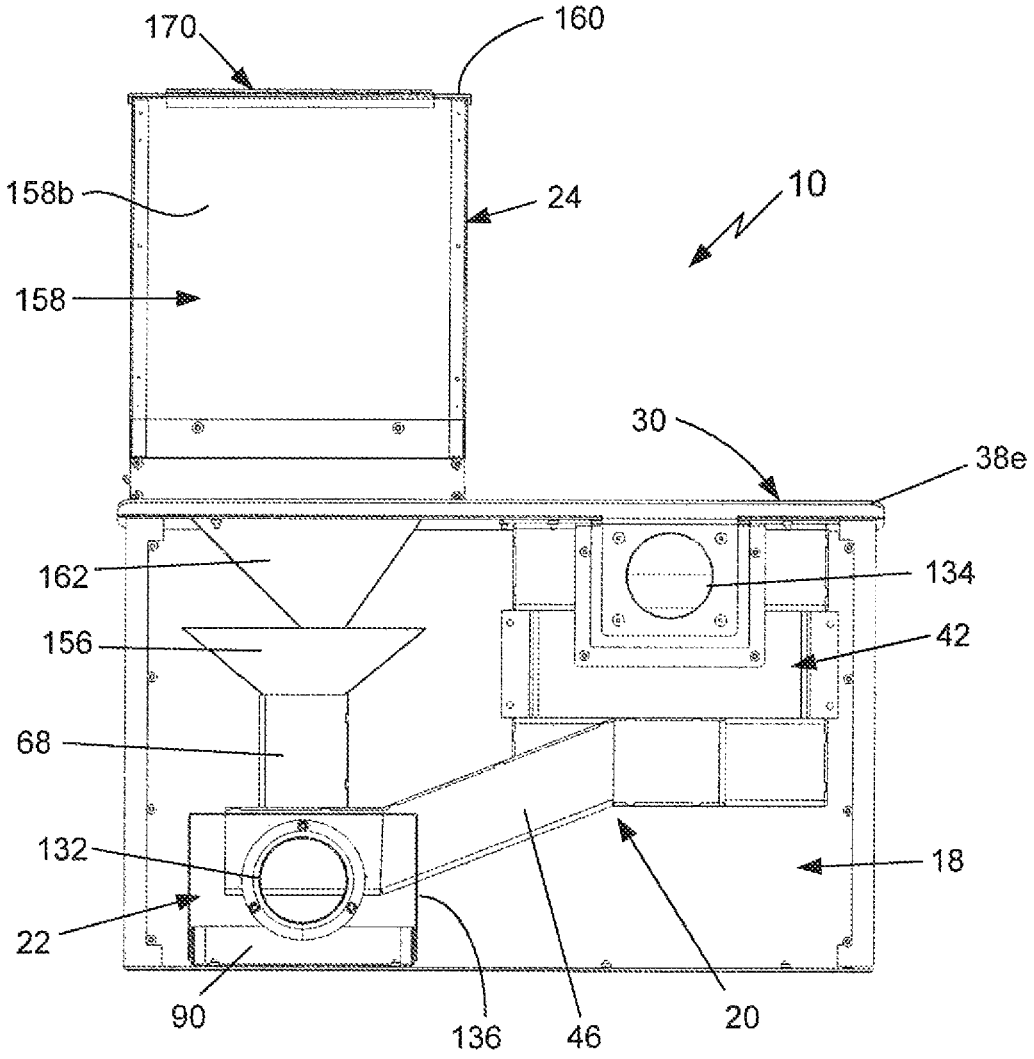
FIG. 11 is a back view of the pellet stove of FIG. 7 shown with the back wall removed.
Figure 13:
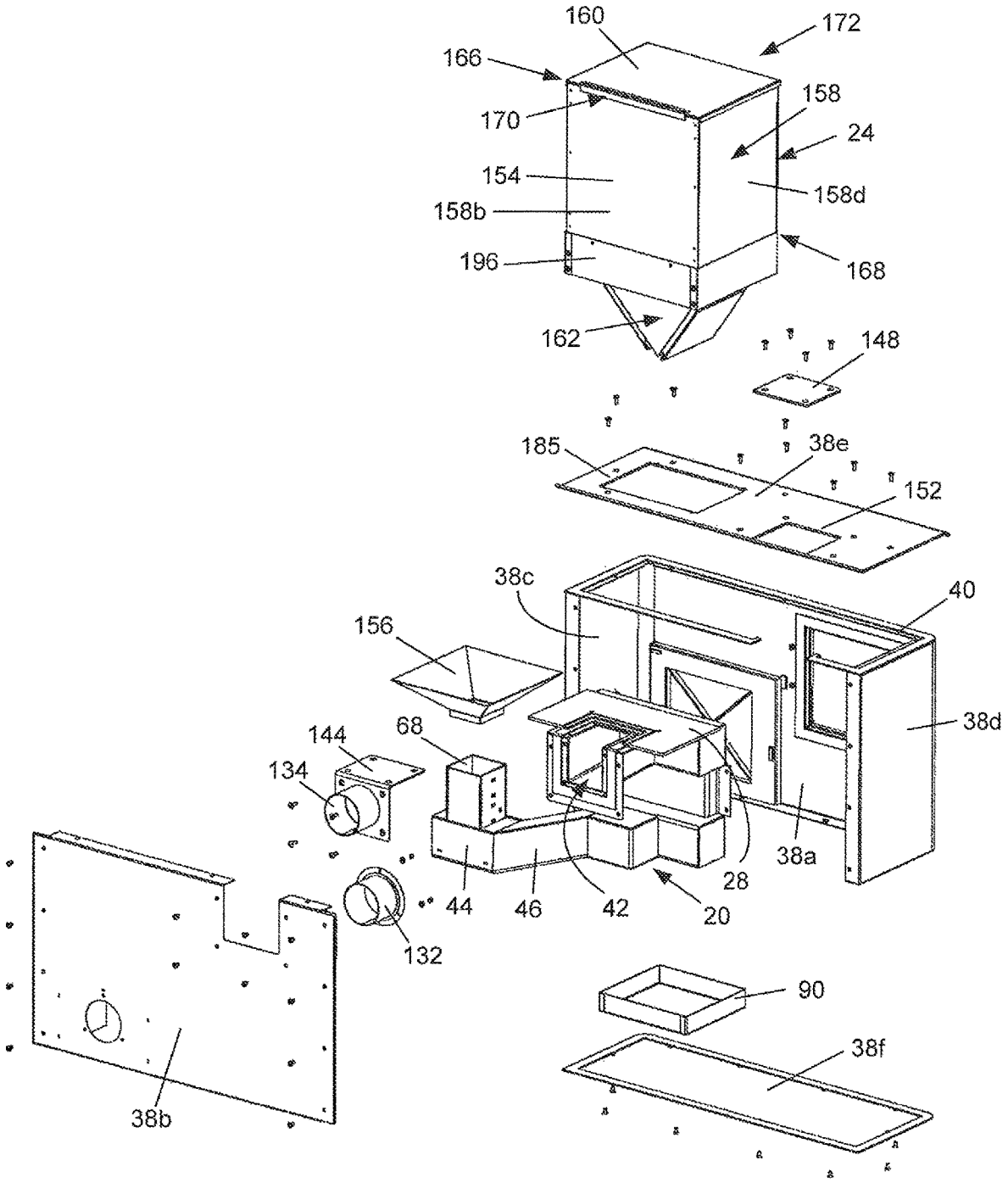
FIG. 13 is a partially exploded back perspective view of the pellet stove of FIG. 1.

As set forth above, in the preferred embodiments of the present invention, the new pellet stove 10 can be utilized for both heating the interior of a structure in which the pellet stove 10 is utilized and for cooking food and heating liquids (in other embodiments, the pellet stove 10 can be utilized only for heating an interior of a structure). To provide the cooking surface 30 for cooking food and heating liquids, the new pellet stove 10 has a hot plate 28 associated with the flame chamber 42 inside the stove enclosure 16 and the top wall 38*e* of the stove enclosure 16, as shown in FIGS. 10-11 and 13. Specifically, the hot plate 28 is positioned above the flame chamber 42 and below and adjacent to, or nearly adjacent to, a lower surface of the top wall 38*e* of the stove enclosure 16 to heat the top wall 38*e* and provide the heating surface 30 of the pellet stove 10 on an upper surface of the top wall 38*e*. The material for the hot plate 28 is selected to be heated and to transfer heat the top wall 38*e* of the stove enclosure 16 to provide the heating surface 30.

Figure 18:
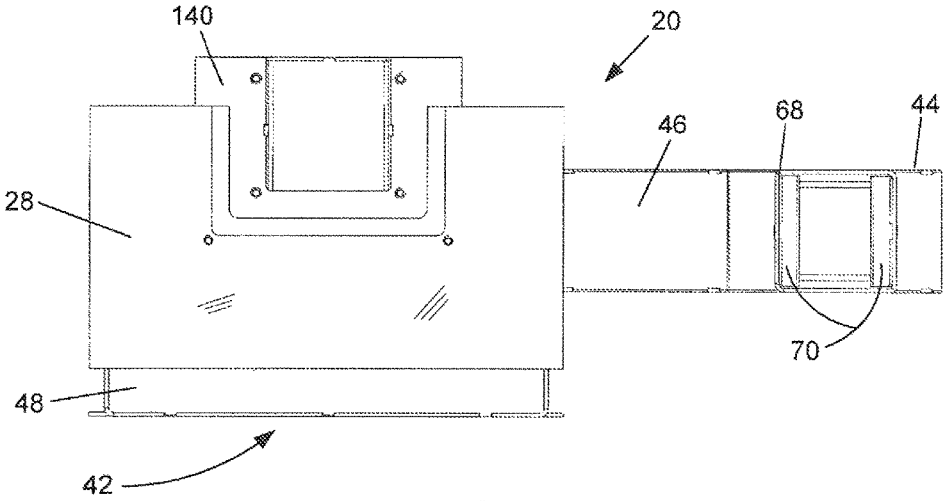
FIG. 18 is a top view of the core assembly of FIG. 14.

The burn chamber housing 44 is open at the top, front, sides and bottom thereof and is sized and configured to receive and support the primary burn chamber assembly 22 therein, which receives pellet fuel 12 from the hopper assembly 24. More specifically, as best shown in FIGS. 14-15, the burn chamber housing 44 is open at its top, front, right and left sides and bottom (i.e., facing toward the hopper assembly 24, solid second door 34 at the front wall 38*a* and the solid third door 36 at the right/second wall 38*c*, first/lower end 62 of the primary burn channel 46 and the bottom wall 38*f* of the stove enclosure 16) to receive the primary burn chamber assembly 22, which is positioned on a pair of burn channel slides 66 at the lower area of the burn chamber housing 44. The burn chamber housing 44 is open at the top to connect to a pellet channel 68 that receives pellet fuel 12 from the hopper assembly 24. The tubular shaped pellet channel 68, which is open at both the upper and lower ends thereof, is sized and configured to direct pellet fuel 12 from the hopper assembly 24 to the primary burn chamber assembly 22 in the burn chamber housing 44 so the pellet fuel 12 may be burned to generate heat to warm the interior of a structure and to allow the user to cook food or heat liquids at the heating surface 30. To help direct pellet fuel 12 to the primary burn chamber assembly 22, the pellet channel 68 has one or more pellet channel baffles 70, as best shown in FIGS. 14 and 18 (which shows the user of two pellet channel baffles 70, one on either side of the pellet channel 68).

The primary burn chamber assembly 22, which is shown in FIGS. 21-34, is structured and arranged to receive the pellet fuel 12 from the hopper assembly 24, burn the pellet fuel 12 and allow the user to control the amount of heat generated by the pellet stove 10 by controlling the amount of pellet fuel 12, as opposed to controlling the intake air as is done by many prior art pellet stoves. The primary burn chamber 22, which is shown with all of its components in FIGS. 21-25, generally comprises a primary burn chamber 72, a burn basket or cradle 74 and a fuel control mechanism 76, as best shown in the exploded view of FIG. 25. The entire primary burn chamber assembly 22 is positioned on the burn channel slides 66 in the burn chamber housing 44 at the first/lower end of the of the primary burn channel 46. As set forth in more detail below, the primary burn chamber assembly 22 is structured and arranged such that the primary burn chamber 72 supports the burn basket 74 and the fuel control mechanism 76 so the pellet fuel 12 from the hopper assembly 24 will be received in the burn basket 74 and the amount of pellet fuel 12 that is allowed to be received in the burn basket 74 and, therefore, burned by the pellet stove 10 is controlled by the user's operative control of the fuel control mechanism 76.

Figure 21:
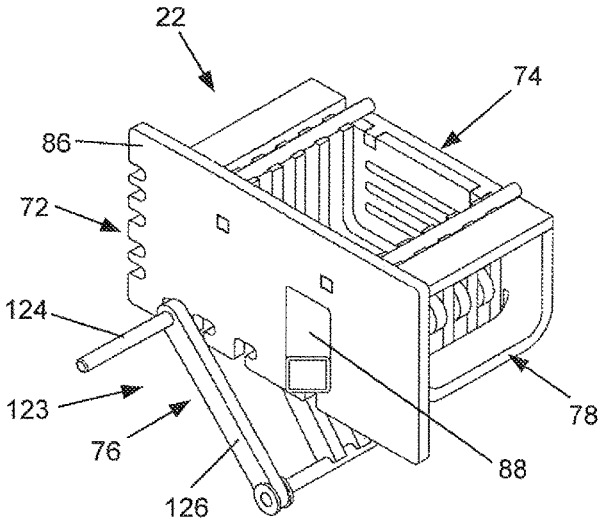
FIG. 21 is a front perspective view of the primary burn chamber assembly of the pellet stove of FIG. 1.
Figure 22:
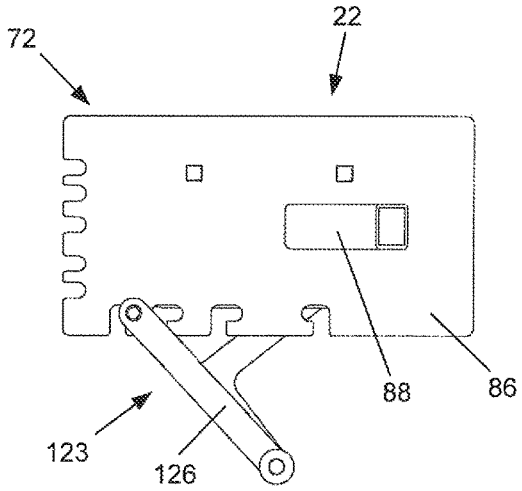
FIG. 22 is a front view of the primary burn chamber assembly of FIG. 21.
Figure 23:
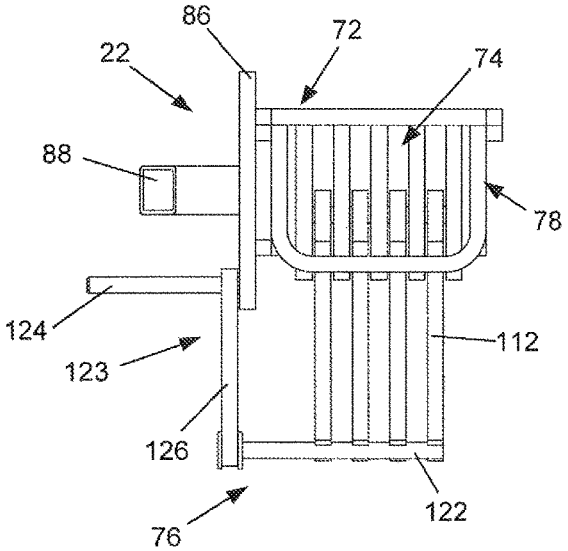
FIG. 23 is a right side view of the primary burn chamber assembly of FIG. 21.
Figure 24:
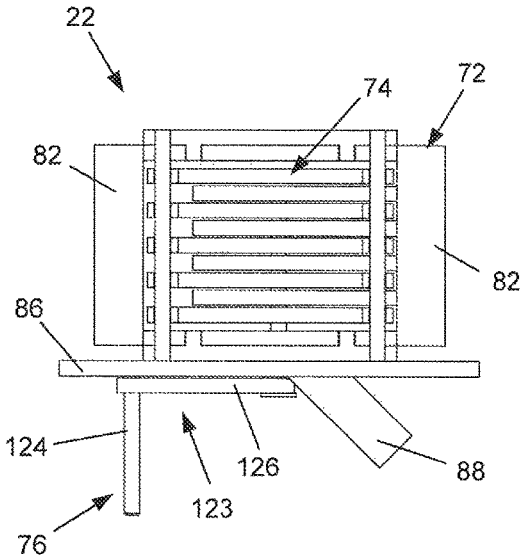
FIG. 24 is a top view of the primary burn chamber assembly of FIG. 21.

The primary burn chamber 72, which is shown separately in FIGS. 26-29, comprises a U-shaped chamber support structure 78 that is open at the upper and lower ends thereof. The chamber support 78 comprises a pair of lower brace members 80 at the lower end and a pair of brace members 82 at the upper end and a plurality of spacer bars 84 that are sized and configured to receive and support the burn basket 74, as best shown in FIGS. 21 and 23-24. The chamber support 78 also comprises a front or face plate 86 with a lighting tube 88 extending outwardly therefrom, as best shown in FIGS. 21-25 and 27-28. The upper end of the chamber support structure 78 is open to receive the burn basket 74, which is supported in the chamber support structure 78 between the pairs of braces 80 and 82 (as shown in FIGS. 21 and 24) and the lower end of the chamber support structure 78 is open to allow ash from the pellet fuel 12 which is burned in the burn basket 74 to fall through the primary burn chamber assembly 22 to an ash pan 90 that is positioned behind the second door 34 below the primary burn chamber assembly 22, as shown in FIGS. 7 and 11-13, so the ash can be removed from the pellet stove 10 through either the second door 34 or the third door 36.

Figure 29:
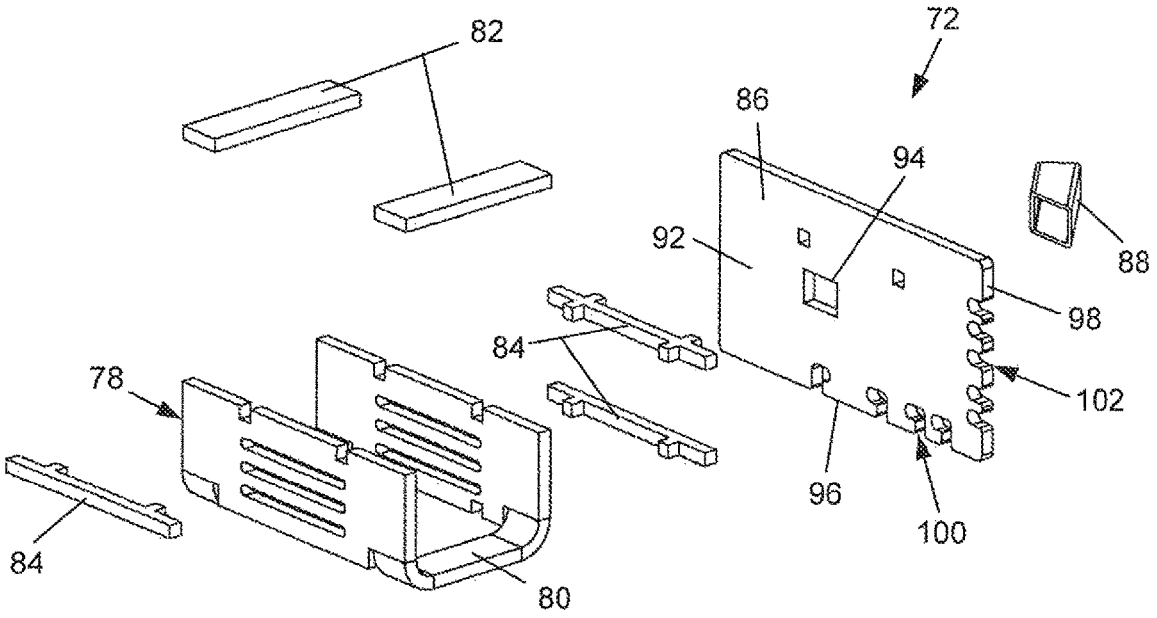
FIG. 29 is an exploded view of the primary burn chamber of FIG. 26.

The face plate 86, which is positioned on the primary burn chamber 72 toward the second door 34 at the front wall 38*a*, has a plate body 92 with an aperture 94 therein and a plurality of control notches on one or more edges thereof, as best shown in FIG. 29. In the figures, the face plate 86 has control notches on the lower edge 96 and left edge 98 thereof, as shown in FIGS. 21-22, 25-27 and 29. Specifically, the lower edge 96 of the face plate 86 has a plurality of lower control notches 100 and the left edge 98 has a plurality of side control notches 102. The lighting tube 88 allows the user to connect a lighting device, such as a lighter, torch or the like, to the interior of the primary burn chamber assembly 22 (where the pellet fuel 12 is located) via the aperture 94 to initiate the process of burning pellet fuel 12 in the burn basket 74 when using the pellet stove 10. As set forth in more detail below, the control notches 100/102 are utilized with the fuel control mechanism 76 to allow the user to allow more or less pellet fuel 12 into the primary burn chamber assembly 22 so as to control the amount of heat that is produced by burning the pellet fuel 12 in the pellet stove 10.

Figure 25:
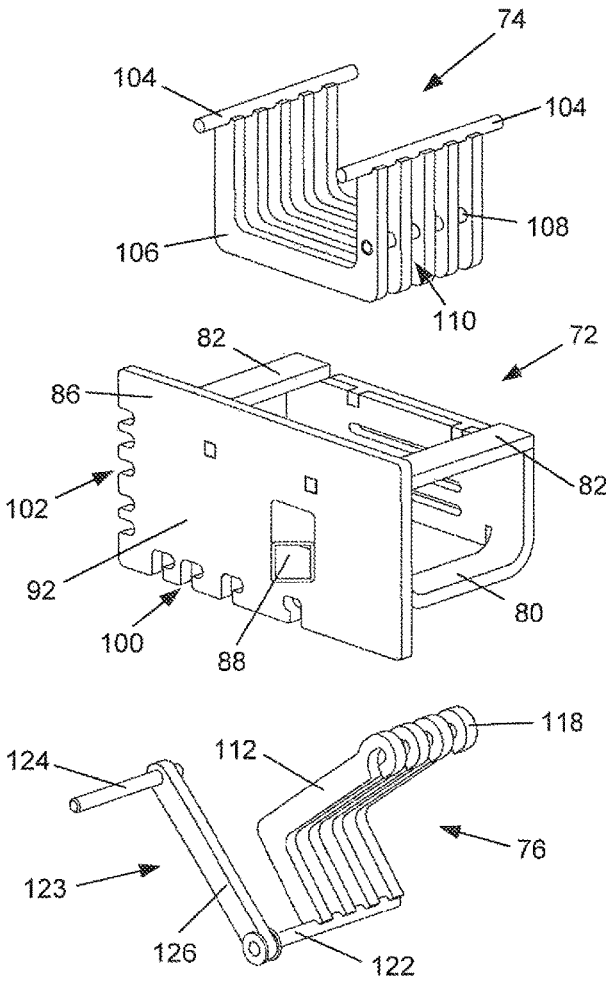
FIG. 25 is an exploded front perspective view of the primary burn chamber assembly of FIG. 21.
Figure 26:
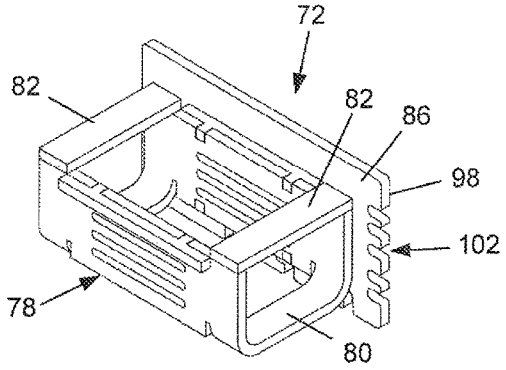
FIG. 26 is a rear perspective view of the primary burn chamber of the primary burn chamber assembly of FIG. 25.
Figure 27:
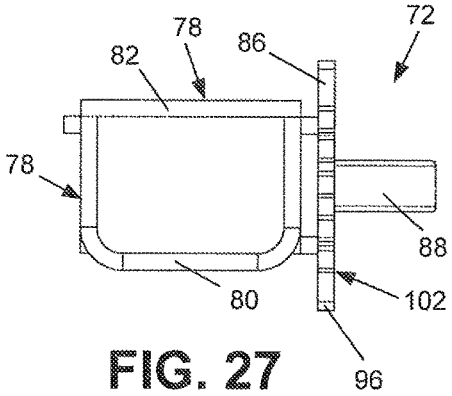
FIG. 27 is a left side view of the primary burn chamber of FIG. 26.
Figure 28:
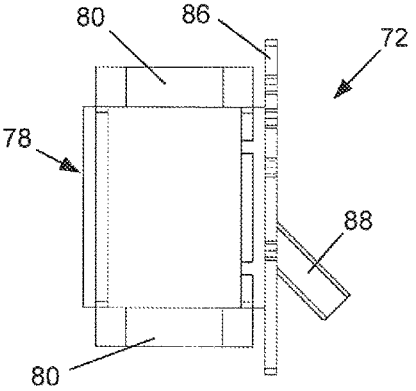
FIG. 28 is a bottom view of the primary burn chamber of FIG. 27.
Figure 30:
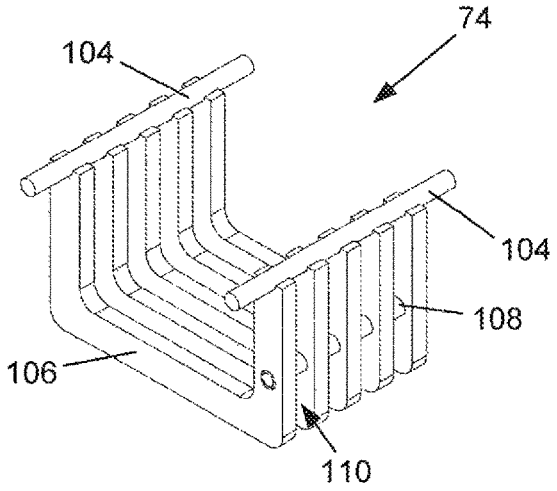
FIG. 30 is a front perspective view of the burn basket of the primary burn chamber assembly of FIG. 25.
Figure 31:
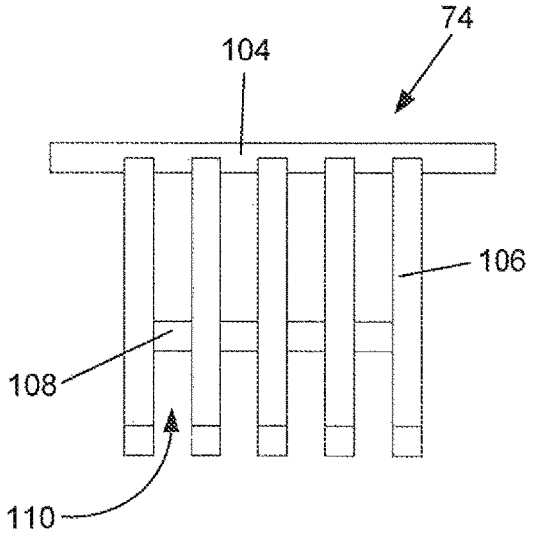
FIG. 31 is a right side view of the burn basket of FIG. 30.
Figure 32:
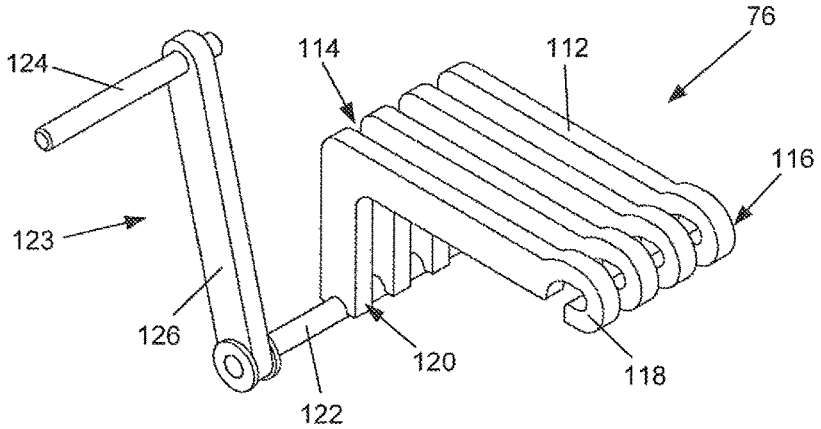
FIG. 32 is a front perspective view of the fuel control assembly of the primary burn chamber assembly of FIG. 24.
Figure 33:
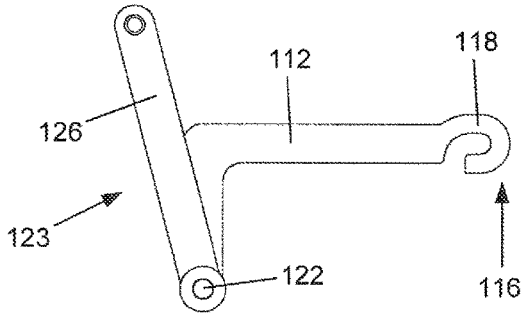
FIG. 33 is a front view of the fuel control assembly of FIG. 32.
Figure 34:
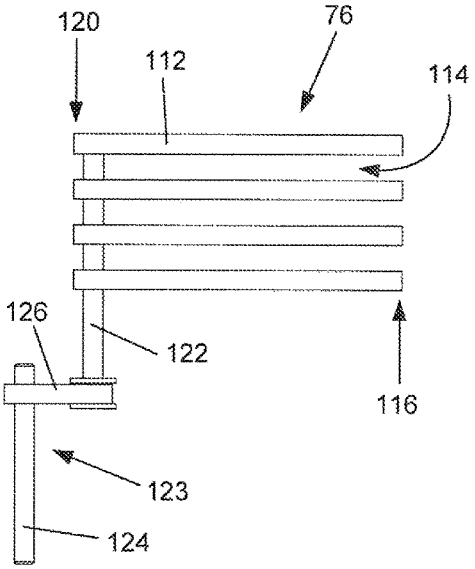
FIG. 34 is a top view of the fuel control assembly of FIG. 33.

The burn basket 74, which is best shown in FIGS. 25 and 30-31, is sized and configured to receive pellet fuel 12 from the hopper assembly 24, via gravity feed, and to hold the pellet fuel 12 therein while it is burning to produce the heat needed to heat the interior of a structure, for cooking food and heating liquids and for the aesthetic view of a fire 14. In the figures, burn basket 74 comprises a pair of round support bars 104 that are positioned in spaced apart, parallel relation to each other, a plurality of spaced apart flat holding bars 106 that are each formed into a U-shaped configuration and which connect at the top of the U-shape of each holding bar 106 to the support bars 104, and a pivot bar 108 that is located through the support bars 104 at or near the middle of one side of the burn basket 74 and which connects, as set forth below, to the fuel control mechanism 76 to control the amount of space for the pellet fuel 12 in the primary burn chamber assembly 22 and, therefore, the amount of heat that is produced by the pellet stove 10. The support bars 104, holding bars 106 and pivot bar 108 are all fixedly attached to each other or integrally configured to form the cradle shape of the burn basket 74 that holds the pellet fuel 12 therein. As best shown in FIG. 31, the holding bars 106 are in spaced apart relation to each other to provide gaps 110 therebetween that allow inlet air to pass through the pellet fuel 12 held in the burn basket 74 and to allow ash to fall through from the burn basket 74 into the ash pan 90 below the primary burn chamber assembly 22. As shown in FIGS. 25 and 30-31, the pivot bar 108 passes through the gaps 110 along apertures in each of the holding bars 106. In other embodiments, a short pivot bar 106 can be positioned in each of the gaps 110 to provide the pivot point for the fuel control mechanism 76.

As set forth above, the fuel control mechanism 76, which is best shown in FIGS. 25 and 32-34, is structured and arranged to increase or decrease the volume of the primary burn chamber assembly 22 available for receiving and storing pellet fuel 12. In the embodiment shown in the figures, the fuel control mechanism 76 comprises a plurality of flat L-shaped control arms 112 that are in spaced apart relation to each other to form a control arm gap 114 between each pair of control arms 112 that are fixed in corresponding relation to the support bars 106 and the gaps 110 between their gaps 110. The distal end 116 of each control arm 112 has a hook 118 that is sized and configured to engage the pivot bar 108 of the burn basket 74 and pivot relative thereto. As shown in FIGS. 25 and 32-34, the proximal end 120 of each control arm 112 is fixedly connected to a pivot rod 122 that is attached to a control lever 123, formed by a handle 124 and connecting bar 126. When the control arms 112 of the fuel control mechanism 76 are connected to the pivot bar 108 of the burn basket 74, the control arms 112 will pivot relative to the holding bars 106 to increase or decrease the area for pellet fuel 12. The handle 124 of the control lever 123 is cooperatively sized and configured with the control notches 100/102 so as to fit into and engage the lower control notches 100 and the side control notches 102 so the area for the pellet fuel 12 can be fixed until resized by the user of the new pellet stove 10 to increase or decrease the amount of heat provided by the pellet stove.

Figure 45:
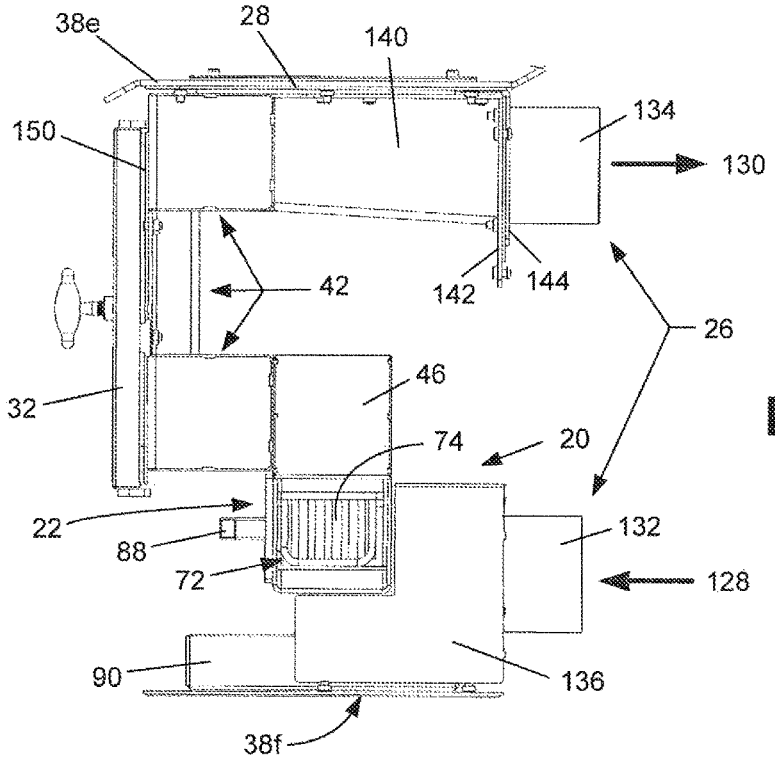
FIG. 45 is a right side view of certain components of the pellet stove of FIG. 1 particularly showing the core assembly and venting system thereof.
Figure 46:
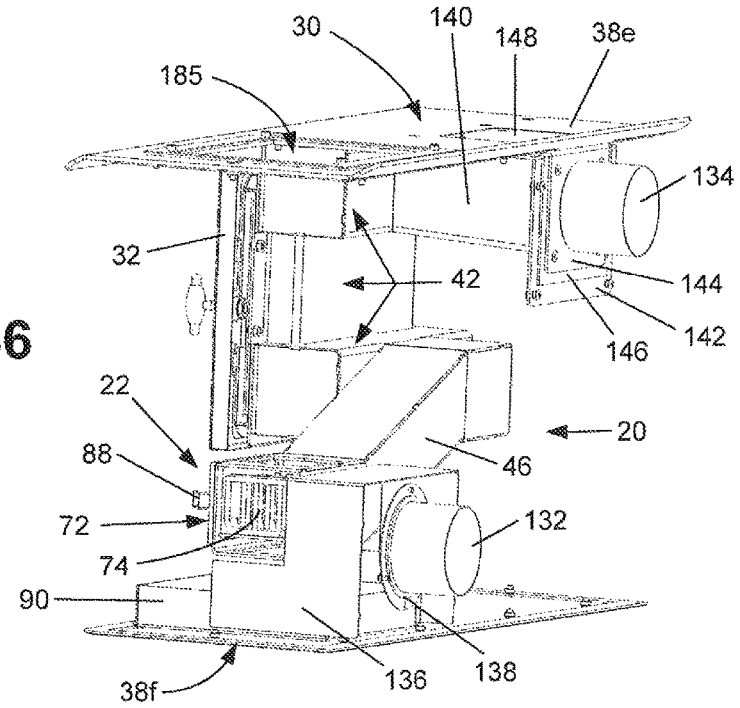
FIG. 46 is a rear perspective view of the components shown in FIG. 45.

As set forth above, the venting system 26 of the new pellet stove 10 is structured and arranged for natural draft operation that, when in use, draws inlet air 128 into the primary burn chamber assembly 22 for combustion that burns the pellet fuel 12 and to flow through the core assembly 20 and out of the pellet stove 10 as exhaust air 130, as shown in FIG. 45. The inlet air 128 is drawn into the new pellet stove 10 through an inlet tube 132 and the exhaust air 130 is discharged from the pellet stove 10 through an exhaust tube 134, as best shown in FIGS. 3-5, 8-10 and 45-46. Associated with the inlet tube 132 is an inlet air shroud 136 having an air inlet gasket 138 that are structured and arranged, as best shown in FIGS. 45-46, to ensure that inlet air 128 is drawn into the primary burn chamber assembly 22 of the pellet stove 10 through the inlet tube 132, as intended and desired, as opposed to being drawn into the pellet stove 10 from outside the inlet tube 132, that can contribute to or cause negative air pressure in the structure in which the pellet stove 10 is being utilized. As also shown in these figures, the venting system 26 is an exhaust channel 140 which is associated with the exhaust tube 134 of the pellet stove 10 to receive exhaust air 130 from the flame chamber 42. The exhaust channel 140 has an exhaust channel rear plate 142 that supports a flue plate 144 to which the exhaust tube 134 is mounted. A flue gasket 146 is positioned between the exhaust tube 134 and the flue plate 144 to ensure that exhaust air 130 is only directed out the pellet stove 10 through the exhaust tube 134 to prevent exhaust air 130 from being discharged to the interior of the building or other structure in which the pellet stove 10 is being utilized. In the embodiment shown in the figures, the flue plate 144 is configured to allow the user to direct the exhaust tube 134 rearward, as shown in the figures, or upward by removing the shim plate 148 at the top wall **38*e* of the stove enclosure 18, as best shown in FIGS. 5, 10, 12-13, 42 and 46, to allow the user to direct the exhaust air 130** rearward or upward.

As described in more detail below, in order to draw inlet air 128 into the pellet stove 10, the inlet tube 132 is connected to an inlet pipe that, typically, extends out a wall to a vent outside of the structure or down through the floor and then to an exterior vent block in the foundation of the structure in which the pellet stove 10 is located. In an installation in which there is no nearby outside wall or the pellet stove 10 is placed on a concrete floor, then the inlet air 128 will be brought in from above the structure to the inlet tube 132. If the pellet stove 10 is placed in front of fireplace, such as on a fireplace hearth, the inlet tube 132 of the pellet stove 10 can be connected to the source of outside air that is associated with the fireplace, such as being brought down through the chimney, to draw inlet air 128 to the inlet tube 132. In any installation of the pellet stove 10, the outside air for the inlet air 128 must have a positive connection to the inlet tube 132 so the pellet stove 10 does not utilize any inside air (i.e., air from inside the structure) to prevent the pellet stove 10 causing or contributing to negative pressure inside the structure. Likewise, the pellet stove 10 is configured and has a number of gaskets, such as the air inlet gasket 138 and the like, so the pellet stove 10 is positively sealed so inlet air 128 cannot enter the pellet stove 10 from anywhere except the inlet tube 132 that is connected to fresh air (for inlet air 128) outside of the structure. Such a configuration meets the United States and Canadian code requirements for mobile homes to have a positive connection to a wood burning stove. Many prior art wood burning stoves cannot meet these requirements.

With regard to the discharge of exhaust air 130 from the pellet stove 10 of the present invention, the pellet stove 10 is configured and has a number of gaskets, such as the top wall gasket 40, the core gasket 150 at the flame chamber 42 (as shown in FIGS. 45-46) and the like, to positively seal the pellet stove 10 so exhaust air 130 will not exit the pellet stove 10 from anywhere except the exhaust tube 134 that is connected to an exhaust pipe that vents the exhaust air to the environment outside of the structure. More specifically, the exhaust tube 134 is connected to one or more venting pipes that can be directed rearward out of the back side of the pellet stove 10 or, by reversing the flue plate 144 so the exhaust tube 134 is facing upward instead of rearward from the exhaust opening 152 in the top wall **38*e* (as shown in FIGS. 13 and 44), so the venting pipe(s) can, if desired, be directed upward and out of the roof of the structure. For a free-standing pellet stove 10, the venting pipe(s) can be utilized to direct the exhaust air 130 out of the structure through a wall or roof. For a pellet stove 10 that is placed on a hearth in front of a fireplace, a connector pipe (not shown) can connect to the exhaust tube 134 and then be run through the fireplace opening and to the existing chimney so the exhaust air 130 is directed up the chimney of the fireplace. As set forth above, in any arrangement of installing and using the new pellet stove 10 of the present invention, the sealing system 26 is configured so the exhaust air 130 only exits the pellet stove 10 through the exhaust tube 134 and then, via positive connections, to outside of the structure to prevent any exhaust air 130 form being discharged into the interior of the structure. Typically, any such connector pipe is a single wall pipe that is run from the pellet stove 10** to the chimney that starts at the roof or wall or, when connecting to a fireplace chimney directly, a stainless steel single wall rigid pipe or flexible liner. The configuration and use of such connector pipes and the like are well known to persons who are skilled in the relevant art.

Figure 40:
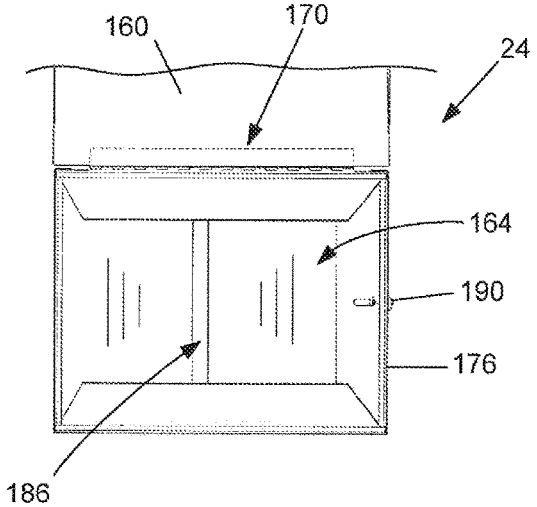
FIG. 40 is a top view of the hopper of FIG. 37 with the lid of the hopper pivoted to an open position to illustrate the pellet storage chamber of the hopper.

As set forth above, the hopper assembly 24 is structured and arranged to hold a quantity of pellet fuel 13, as best shown in FIG. 40, that is directed into the primary burn chamber assembly 22 by gravity feed so that the pellet stove 10 does not require any mechanical mechanism to direct pellet fuel 12 into the primary burn chamber assembly 22.

Figure 7:
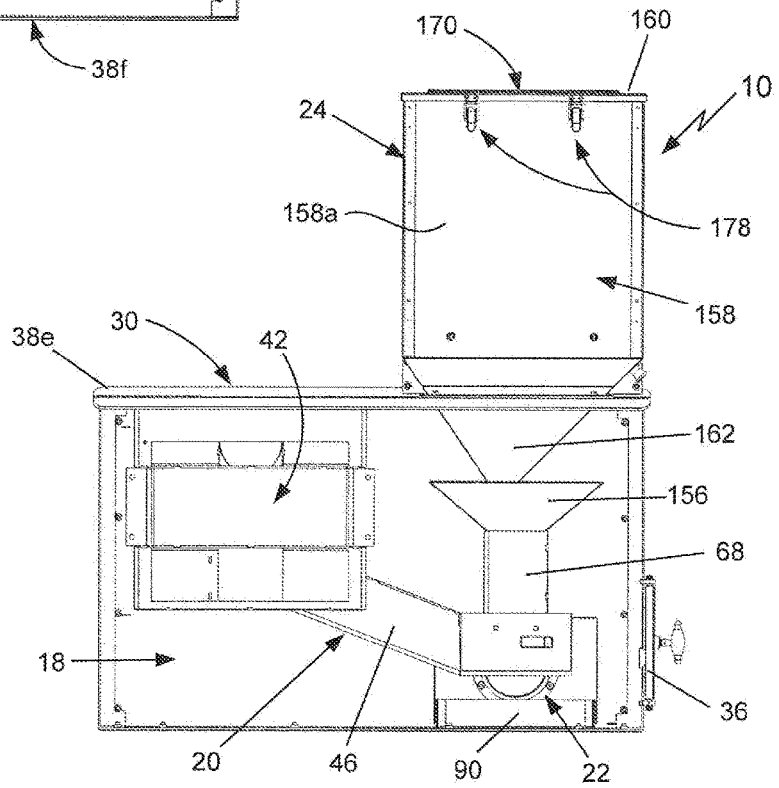
FIG. 7 is a front view of the pellet stove of FIG. 1 shown with the front walls, front doors and storage bin skirt removed to illustrate the interior of the new pellet stove and the connection of the storage bin to the interior components.
Figure 8:
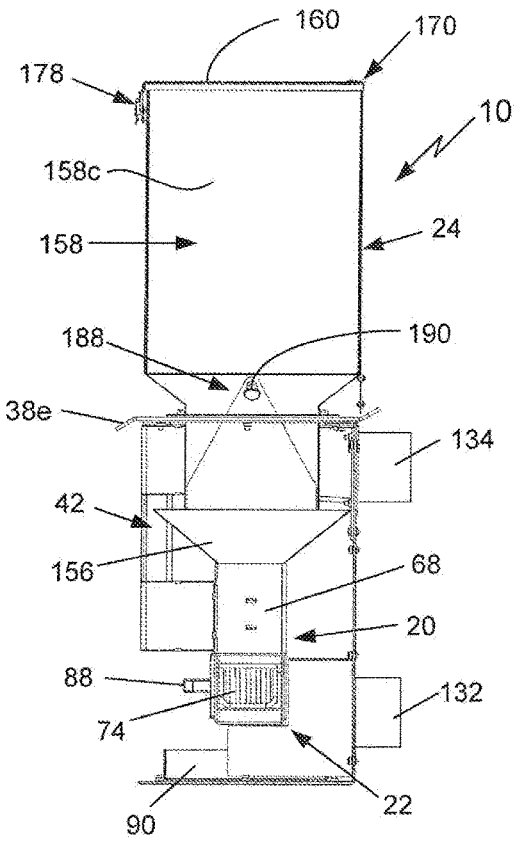
FIG. 8 is a right side view of the pellet stove of FIG. 7 shown with the right side wall and door removed.
Figure 9:
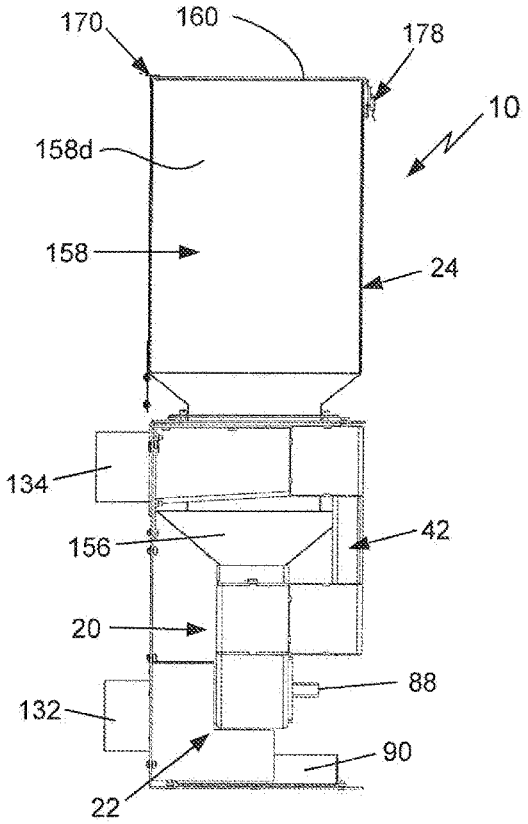
FIG. 9 is a left side view of the pellet stove of FIG. 8 shown with the left side wall removed.

As best shown in FIGS. 35-40, the hopper assembly 24 generally comprises a bin or hopper 154 that is configured to hold the quantity of stored pellet fuel 13 therein and a pellet chute 156 that directs pellet fuel 12 from the hopper 154 to the pellet channel 68, which then directs pellet fuel 12 into the burn basket 74 of the primary burn chamber assembly 22, as shown in FIGS. 7-8 and 10. The hopper 154 comprises a plurality of hopper walls 158, a hopper lid 160 and a shaped bottom section 162 that, collectively, are configured to enclose a pellet storage chamber 164 that stores the quantity of pellet fuel 13 which will be burned in the primary burn chamber assembly 22 to produce the fire 14 seen in the flame chamber 42 (when pellet stove 10 has the glass panel 37 in the first door 32, as shown in FIG. 41). The hopper walls 158 comprise a first or front wall 158*a*, a second or back wall 158*b*, a third or right side wall 158*c* and a fourth or left side wall 158*d* that are integrally formed or securely connected together so as to define the pellet storage chamber 164 that stores the quantity of pellet fuel 13. With regard to FIG. 41, the quantity of pellet fuel 13 is shown behind the first/front wall 158 of the hopper 154. As will be readily appreciated by persons who are skilled in the art, the walls 158 of the hopper 154 can be opaque, transparent or something somewhat therebetween. The walls 158 of the hopper 154, as well as the hopper lid 160 and the shaped bottom section 162, need to be solid to prevent any smoke from flowing from the hopper assembly 24 to the interior of the structure in which the pellet stove 10 is being utilized.

In the embodiment shown in the figures, the walls 158 of the hopper 154 form an enclosure that is open at the top or upper end 166 thereof and open on the bottom or lower end 168 thereof, with the lid 160 at the top/upper end 166 and the shaped bottom section at the bottom/lower end 168. The hopper lid 160 is sized and configured to fully close the open top/upper end 166. To allow the user to conveniently place pellet fuel 12 in the pellet storage chamber 164, the hopper lid 160 of the hopper 154 is pivotally attached to one of the walls 158 by a pivot mechanism 170 to move between a closed position 172 and an open position 174, as best shown with regard to FIGS. 35 and 40. In the embodiment shown in the figures, the pivot mechanism 170 is a hinge or hinge-like device and the hopper lid 160 is pivotally attached to the second/back wall 158*b*. To ensure that smoke spillage into the interior of the structure does not occur during use of the pellet stove 10, the hopper assembly 24 has a lid sealing mechanism 176, such as a gasket or the like, that is sealably associated with the hopper lid 160 and top/upper end 166 of the walls 158 of the hopper 154, such as shown in FIG. 40, to sealably close the pellet storage chamber 164 when the hopper lid is in its closed position 174. As will be readily understood by persons who are skilled in the relevant art, the hopper lid 160 can be pivotally attached to or otherwise removably associated any one of the walls 158 at the top/upper end 166 of the hopper 154 and the lid sealing mechanism can be something other than a gasket. In addition, if desired, the lid could be fixed to or integral with the top/upper end 166 of the walls 158 of the hopper 154 and the hopper 154 can have a door or window in one or more of the walls 158 that can be opened and sealably closed to allow the user to add pellet fuel 12 to the pellet storage chamber 164.

To secure the hopper lid 160 in its sealed closed position 174, with the lid sealing mechanism 176 between the hopper lid 160 and the top/upper end 166 of the walls 158, the hopper assembly 24 has a lid securing mechanism 178 that secures the hopper lid 160 in its closed position 174, as best shown in FIGS. 1-2, 35-39, 41 and 47, at the upper end 166. In the embodiment shown in the figures, the lid securing mechanism 178 is a pair of latches that interconnect the hopper lid 160 and the front wall 158*a* of the hopper 154 to lock the hopper lid 160 in its closed position 174. As will be readily understood by persons who are skilled in the relevant art, the lid securing mechanism 178 can be any type of device that can secure the hopper lid 160 in its closed position 172 to help prevent smoke spillage through the hopper assembly 24 into the interior of the structure where the pellet stove 10 is being utilized. As will also be readily appreciated by persons who are skilled in the relevant art, the configuration and placement of the lid securing mechanism 178 is likely to be at least somewhat dependent on the configuration and location of the lid pivot mechanism 170.

Figure 12:
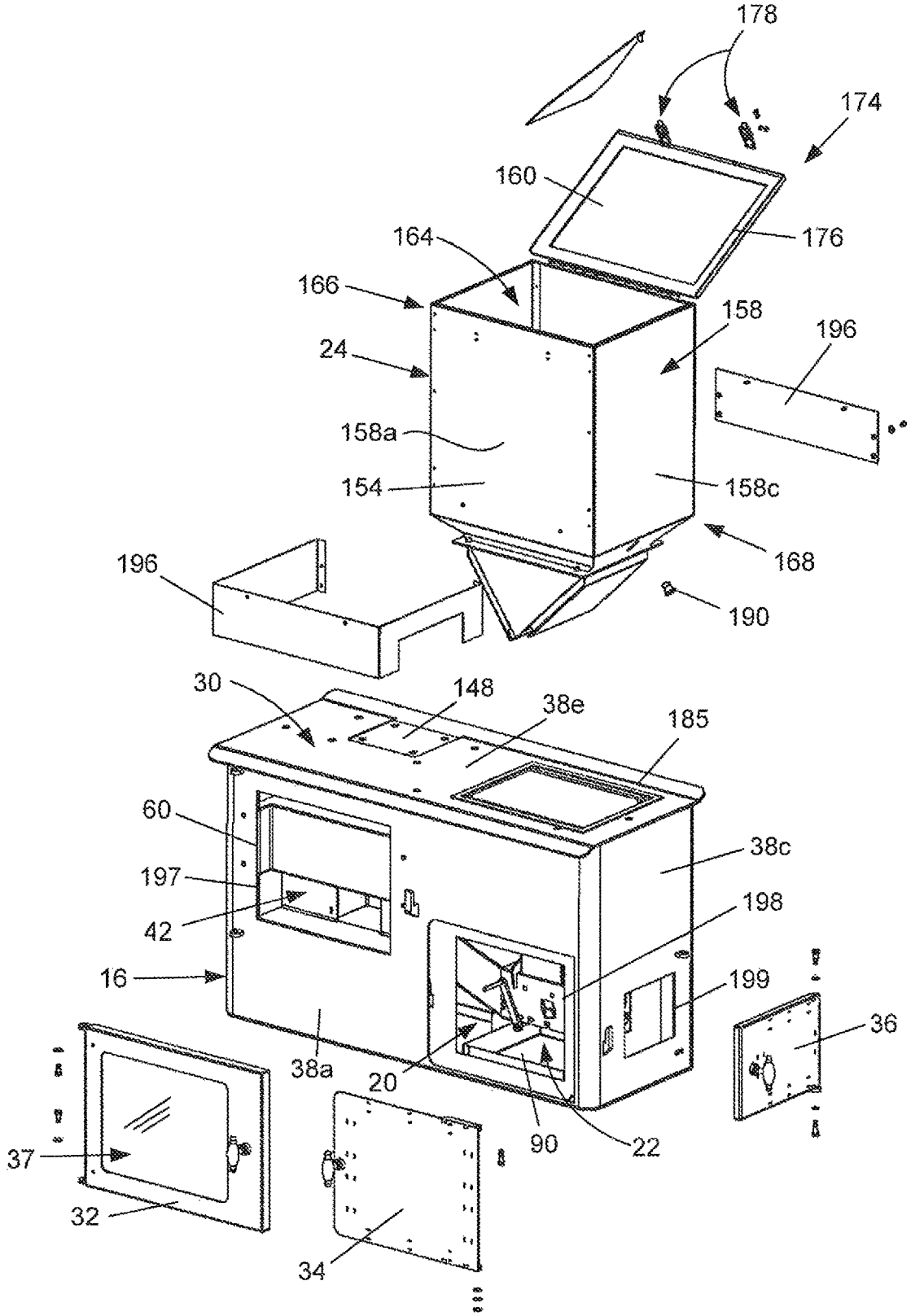
FIG. 12 is a partially exploded front perspective view of the pellet stove of FIG. 1.
Figure 35:
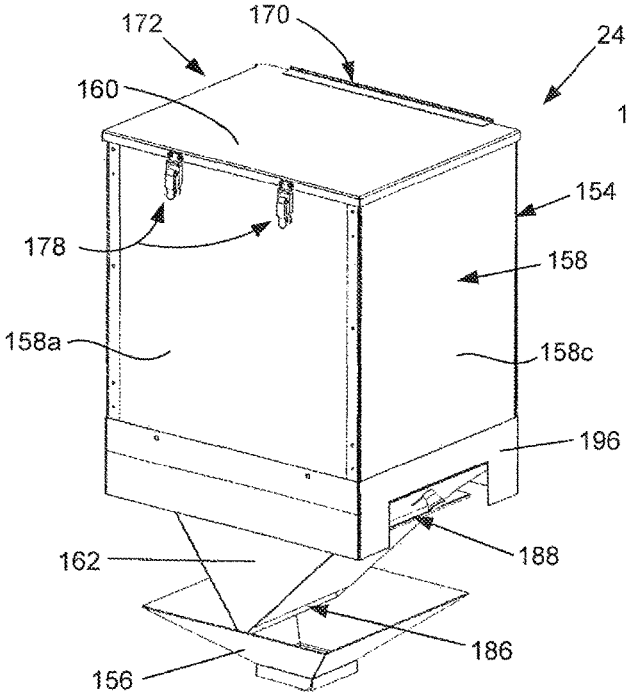
FIG. 35 is a front perspective view of the hopper assembly of the pellet stove of FIG. 1.
Figure 36:
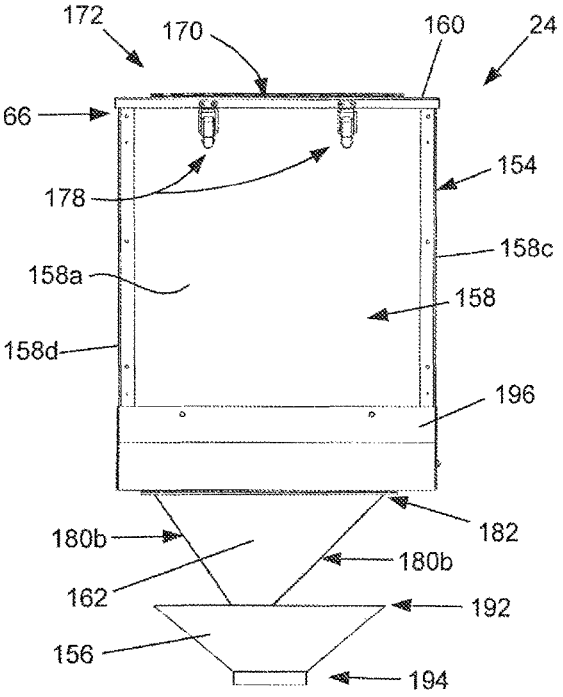
FIG. 36 is a front view of the hopper assembly of FIG. 35.
Figure 37:
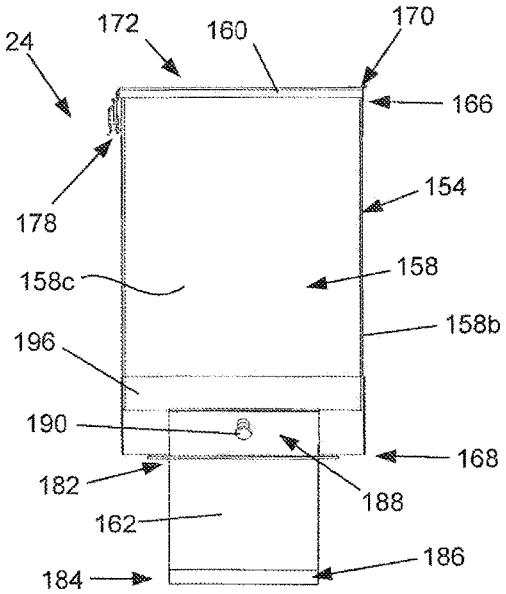
FIG. 37 is a right side view of the hopper of the hopper assembly of FIG. 35, which is shown without the pellet chute thereof to better illustrate the discharge opening of the hopper.
Figure 38:
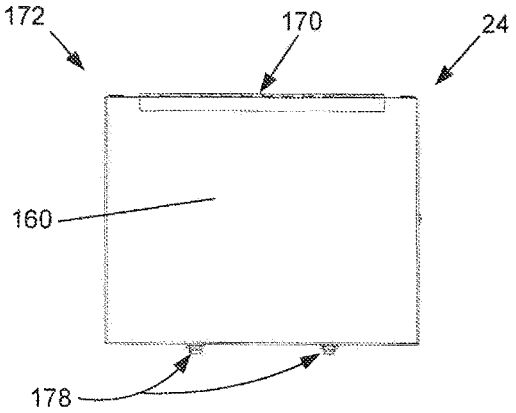
FIG. 38 is a top view of the hopper of FIG. 37 with the lid thereof shown in its closed position.
Figure 39:
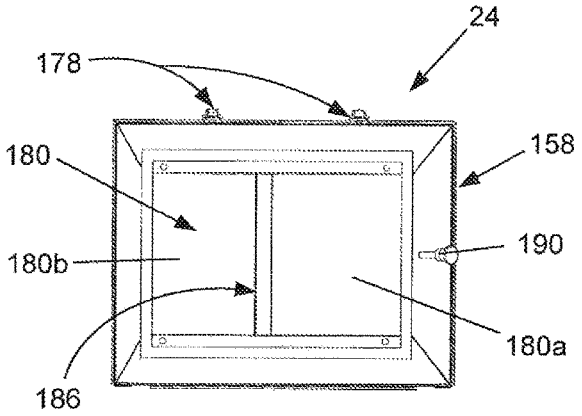
FIG. 39 is a bottom view of the hopper of FIG. 37.

The shaped bottom section 162 is shaped and configured to facilitate gravity feed of pellet fuel 12 from the pellet storage chamber 164 of the hopper 154 into the burn basket 74 of the primary burn chamber assembly 22. As shown in FIGS. 35-36 and 40, the shaped bottom section 162 has sidewalls 180 that are angled downward from the bottom/lower end 168 of the walls 158 of the hopper 154 so as to direct pellet fuel 12 into the pellet chute 156. The shaped bottom section 162 has an open upper end 182 that is attached to or integral with the lower end 168 of the walls 158 of the hopper 154 and a lower end 184 that extends toward or into the funnel-shaped pellet chute 162, as best shown in FIGS. 7, 11 and 35-36, through the hopper opening 185 in the top wall 38*e* of the stove enclosure 16, as best shown in FIGS. 12-13. The hopper opening 185 has a gasket or other sealing mechanism that seals the area between the hopper assembly 24 and the top wall 38*e* to prevent the flow of air or smoke between these components. The lower end 184 of the bottom shaped section 162 defines a fuel discharge opening 186 that allows pellet fuel 12 to fall from the quantity of pellet fuel 13 in the pellet storage chamber 164 into the pellet chute 156 and an adjustment mechanism 188 that allows the user to adjust the fuel discharge opening 186 to allow more or less pellet fuel 12 to fall into the pellet chute 156, as best shown in FIGS. 35 and 37. In the embodiment shown in the figures, the adjustment mechanism 188 comprises the shaped bottom section 162 being configured to allow one of the sidewalls 180 (i.e., sidewall 180*a*) thereof being allowed to slide upward or downward relative to the opposing sidewall 180*b* so as to open or close the discharge opening 186. A pull/push knob 190 is utilized by the user to slide the subject sidewall 180*a* upward to open or further open the discharge opening 186 or to slide the sidewall 180*a* downward to close or partially the discharge opening 186, which will close of the pellet fuel 12 from the primary burn chamber assembly 22 and cut-off the pellet fuel 12 to the burn basket 74.

As set forth above, the pellet chute 156 has a generally funnel-shaped configuration with an open upper end 192 and an open lower end 194, as best shown in FIGS. 7-9, 11 and 35-36 to facilitate flowing, by gravity, pellet fuel 12 from the quantity of pellet fuel 13 stored in the hopper 154 of the hopper assembly 24 to the primary burn chamber assembly 22, via the pellet channel 68, where pellet fuel 12 is burned to create heat for the heating the interior of a structure and allow for cooking food or heating liquid. The open top end 192 of the pellet chute 156 is positioned below the hopper assembly 22 to receive pellet fuel 12 from the hopper 154. The open lower end 194 is connected to or integrally formed with the upper end of the pellet channel 68. Pellet fuel 12 flows through the pellet channel 68 to the primary burn chamber assembly 22. More specifically, the pellet chute 156 is sized and configured to receive pellet fuel 12 that is released from the quantity of pellet fuel 13 in the pellet storage chamber 164 of the hopper 154 through the fuel discharge opening 186 at the shaped bottom section 162 thereof to funnel the discharged pellet fuel 12 into the pellet channel 68 where the pellet channel baffles 70 therein direct the pellet fuel 12 into the burn basket 74 of the primary burn chamber assembly 22.

The pellet stove 10 of the present invention has a hopper skirt 196 that is positioned around the lower end 168 of the walls 158 of the hopper 154 to cover the area between the hopper 154 and the top wall 38*e* of the stove enclosure 16, as shown in FIGS. 1-4 and 6. The hopper skirt 196 is shown removed from the pellet stove 10, as well as other certain other walls of the stove enclosure 16 and the hopper assembly 24 in FIGS. 7-9 and 11. As best shown in FIG. 12, in the embodiment shown in the figures, the hopper skirt 196 is shaped and configured to entirely encircle the area between the lower end 168 of the walls 158 of the hopper 154 and the top wall 38*e* and provide the user access to the push/pull knob 190 of the adjustment mechanism 188 below the third/right wall 158*c* of the hopper 154. The hopper skirt 196 is primarily utilized for aesthetic purposes.

The pellet stove 10 of the present invention is designed with its burn system and air supply and discharge systems being effectively sealed within a box, which solves the issue pertaining to causing or contributing to negative pressure inside a structure and solves the issue with smoke spillage into the structure. As will be readily appreciated by persons who are skilled in the art, a variety of gaskets and other sealing mechanisms are used throughout the pellet stove 10 to prevent air from inside the structure in which the pellet stove 10 is utilized being drawn into the pellet stove 10 or exhaust air 130 from the pellet stove 10 being discharged to the interior of the structure. In addition, the various pipes and tubes that are utilized to draw fresh inlet air 128 into the pellet stove 10 and to discharge exhaust air 130 to an area outside of the structure in which the pellet stove 10 is being utilized and the various connections therebetween and to the inlet tube 134 or exhaust tube 136 are sealed or otherwise configured so as to prevent drawing inlet air 128 into the pellet stove 10 or discharging exhaust air 130 to the interior of the structure. Persons who are skilled in the relevant art are readily familiar with gaskets, devices and configurations to ensure that the pellet stove 10 and the connections thereto can be appropriately sealed.

The pellet stove 10 can be utilized on a hearth associated with a fireplace or as a free-standing stove. The pellet stove 10 operates on a fuel level control rather than an air level control and eliminates burn issues with prior stove operations, including issues of back burn into hopper assembly 22 and smoke spillage into the home caused by improper installation or energy tight homes with negative pressure issues. As such the new pellet stove 10 can be connected to most any fireplace, which previous wood stoves were unable to achieve. The pellet stove 10 also provides a cooktop area for heating food and water. As set forth above, the new pellet stove addresses user objections with regard to prior art wood stoves having a limited view of a fire 14. In the preferred configurations of the present invention, the new pellet stove 10 has a much larger fire and aesthetic view of the fire than prior art wood stoves. As will be readily appreciated by persons skilled in the art, the new pellet stove 10 has a better overall appearance and more conventional stove appearance that users commonly desire.

The components of the pellet stove 10 are designed and engineered to fit together through a sequence that assures an airtight stove enclosure 16 that is bolted and sealed using both welds and gaskets, as well as insulation materials, so the new pellet stove 10 that functions as intended and can be easily repaired in the event any component of the pellet stove 10 fails. As shown in the figures, such as FIGS. 1-5, the pellet stove 10 has handles or other devices on each of the stove doors 32/34/36 that are utilized to open and close the stove doors 32/34/36. The area around the openings for the doors 32/34/36, which openings are respectively shown as first door opening 197, second door opening 198 and third door opening 199 in FIG. 12, are sealed with gaskets or other sealing mechanisms that prevent air from being drawing into or discharged out of the pellet stove 10 through the openings 197/198/199. In the preferred embodiments, the doors 32/34/36 are configured with appropriate latching mechanisms and the like that allow the user to secure the doors 32/34/36 in their closed position so they cannot be accidently opened. If desired, an accessory oven can be placed on top of the heating surface 30 of the pellet stove 10 for use of the pellet stove 10 for baking and the like cooking. A separate, appropriately configured container can be placed on top of the heating surface 30 for using the pellet stove 10 to heat water and other liquids. The new pellet stove is comprised of various thicknesses of sheet metal, stainless steel, glass, gaskets and connecting mechanisms (including nuts/bolts, screws and the like) that make up the pellet stove 10, much like all other appliances designed to perform the same or similar functions. Unlike prior art pellet or other types of wood stoves, however, the pellet stove 10 of the present invention accomplishes the desired objectives by use of gravity feed for the pellet fuel 12 verses most prior art pellet stoves that require electricity to operate and have numerous problems with mechanical breakdowns.

After being installed on a hearth or in a free-standing configuration, the user of the pellet stove 10 loads pellet fuel 12 into the hopper 154 to provide a quantity of pellet fuel 13 in the pellet storage chamber of the hopper 154. In one configuration, the hopper 154 is sized and configured to hold approximately eighty pounds of pellet fuel 12. The loading of the pellet fuel 12 is accomplished by releasing the lid securing mechanism 178, opening the hopper lid 160 and pouring in a desired quantity of pellet fuel 13. Once filled to the desired level, the user closes the hopper lid 160 and operatively engages the lid securing mechanism 178 (i.e., latching the latches) to securely and sealably close the hopper 154. The user then opens the second door 34 and adjusts the fuel control mechanism 76 to its highest setting, which is marked on the front/face plate 86, by engaging the designated lower control notch 100 or side control notch 102. Once set, the user closes and secures the second door 34 and operates the adjustment mechanism 188 located at the right and bottom side of the hopper 154 to fill the burn basket 74 positioned below the hopper 154 below. The pellet stove 10 is now ready to light. The user then opens the third door 36 and inserts a propane torch or other lighting device so the flame thereof is held against the pellet fuel 12 in the burn basket 74 for a sufficient time for the pellet fuel 12 to light, typically approximately four to eight minutes. Alternatively, the user can hold a heat gun against the pellet fuel or insert fire starters into the primary burn chamber 72 prior to opening the adjustment mechanism 188 on the hopper 154. The pellet stove 10 can take ten to fifteen minutes to get up to its operational temperature and lighting procedure can vary in time depending on which method the uses choose. Temperatures inside and outside the structure be a factor effecting start up of the pellet stove 10. Extreme conditions can cause the pellet stove 10 to take thirty to forty-five minutes to reach the desired operational temperature.

After following the lighting instructions set forth above, the user merely has to sit back and let the new pellet stove 10 operate at its initial setting. As the interior of the structure comes up to the desired temperature, the user then opens the first door 32 and moves the control lever 123 of the fuel control mechanism 76 to a lesser setting until the interior of the structure reaches the desired or optional temperature. As will be readily appreciated by persons who are skilled in the art, all homes or other structures vary in how long it takes to reach the desired heat level and, as a result, it will take some getting used to before finding the setting that is best suited for the particular circumstances with regard to the structure in which the pellet stove 10 is utilized. The user should check the burn basket 74 from time to time to make sure excessive ash has not built up therein, which ash can cause the pellet stove 10 to loose heat output. The build-up of ash can happen when the pellet stove 10 is utilized in a lower setting for long periods of time. Any excessive ash build-up can be removed by simply shaking the control lever 123 of the fuel control mechanism 76 to cause the pellet stove 10 to come back up to the user's desired temperature.

Figure 47:
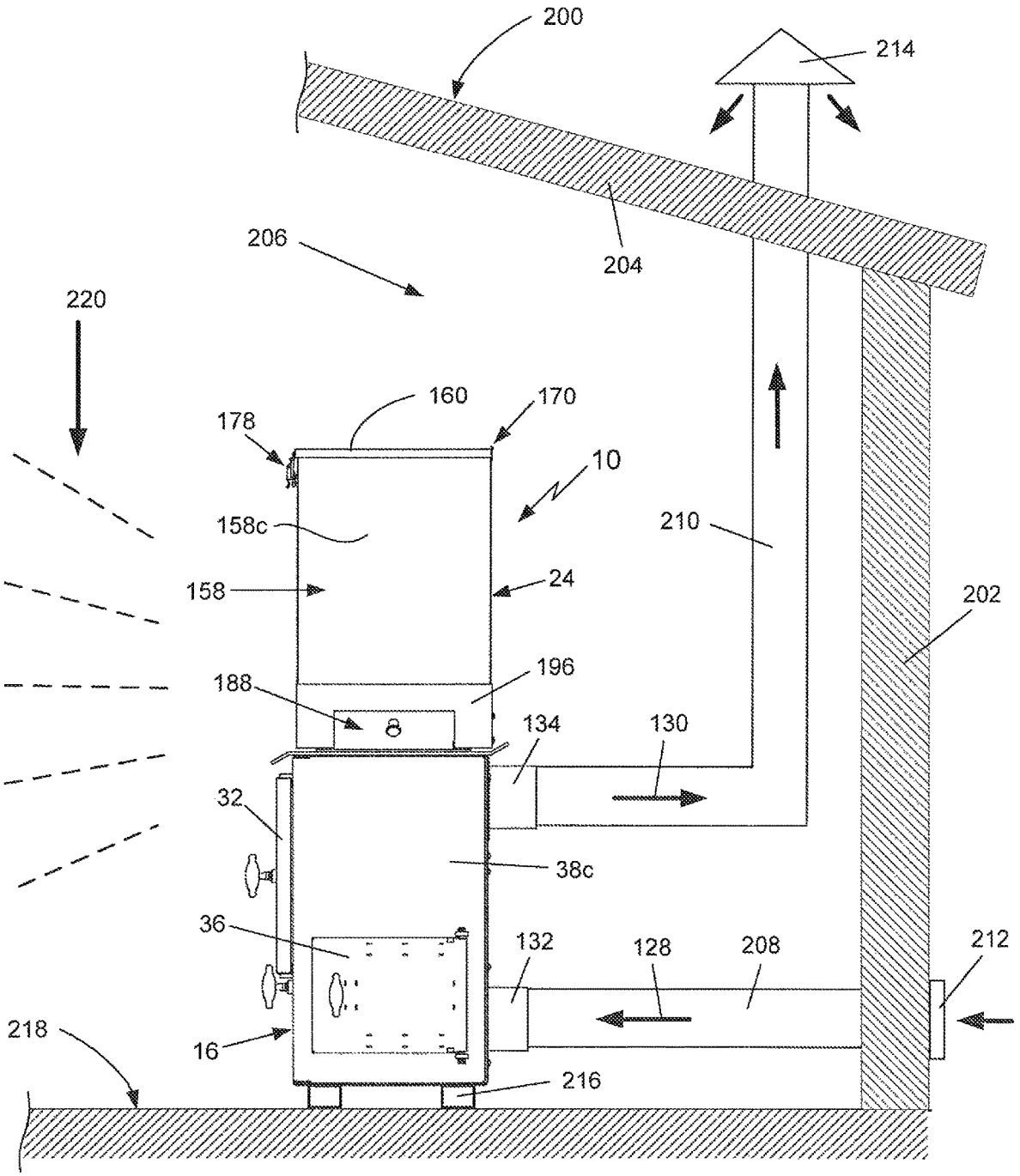
FIG. 47 is a right side view of the pellet stove of FIG. 1 shown in the interior of a structure and being connected to an inlet pipe that extends through a wall of the structure and an exhaust pipe that extends through the roof of the structure.

One possible use of the new pellet stove 10 of the present invention is shown in FIG. 47. In this figure, the pellet stove 10 is shown in a structure 200 having a wall 202 and a roof 204 that define an interior 206 of the structure 200. An inlet pipe 208 is connected to or integral with the inlet tube 132 and the exhaust tube 134 is connected to or integral with an exhaust pipe 210. The inlet pipe 208 is connected to a vent 212 that allows the inlet air 128 to be drawn into the primary burn chamber assembly 22 of the pellet stove 10 through the inlet pipe 208 and inlet tube 132. In the preferred embodiments, the inlet air 128 flows into the pellet stove 10 without the use of any fans or other powered devices. The exhaust air 130 is drawn out of the structure 200 (such as above the roof 204) from the flame chamber 42 of the pellet stove 10 through the exhaust tube 134 and exhaust pipe 210, as shown in FIG. 47. Typically, the exhaust pipe 210 will terminate at a pipe or chimney cap 214. In the embodiment shown in FIG. 47, the pellet stove 10 is positioned in the interior 206 of the structure 200 in a free-standing manner, as opposed to be placed on a hearth in front of a fireplace. Specifically, the pellet stove 10 is shown with stove legs 216 that are sized and configured to support the pellet stove 10 on a support surface 218, such as a floor or other hardened area in the interior 206 of the structure 200. During use of the pellet stove 10, the burning pellet fuel 12 produces a fire 14 in the primary burn chamber assembly 22, which can be seen in the flame chamber 42 through the glass panel 37 (as shown in FIG. 41), to produce heat 220 that warms the interior 206 of the structure 200 and heats the heating surface 30 for cooking food and/or warming liquids.

In operation, the new pellet stove 10 is structured and arranged to burn pellet fuel 12 by utilizing gravity feed to direct pellet fuel 12 to the burn basket 74 located below the hopper assembly 24 by opening the fuel discharge opening 186 thereof by operating the adjustment mechanism 188. The control lever 123 of the fuel control mechanism 76 is operated to control the amount of pellet fuel 12 that is allowed to be received in the burn basket 74. The pellet fuel 12 in the burn basket 74 is lit by using one of several methods described above, or others. Once the pellet fuel 12 in the burn basket 74 is burning, inlet air 128 will be drawn into the primary burn chamber assembly 22 through the vent tube 132 and vent pipe 208, as shown in FIG. 47, to contribute to combustion of the pellet fuel 12. As will be readily appreciated by persons who are skilled in the art, the amount of pellet fuel 12 in the burn basket 74 controls, as the pellet fuel 12 is burned, the amount of heat 220 that is produced by the pellet stove 10. Burning the pellet fuel 12 causes fire 14 and hot gasses to flow through the core assembly 20 of the pellet stove 10, including the flame chamber 42 thereof, to heat the metal components of the pellet stove 10 to radiate heat 220 into the interior 206 of the structure 200 in which the new pellet stove 10 is located. As set forth above, the exhaust air 130 flows out the exhaust tube 134 and up the chimney or otherwise out the structure, such as through a wall 202 or roof 204, via the exhaust pipe 210. The amount of pellet fuel 12 burning in the burn basket 74 regulates how hot the pellet stove 10 becomes and achieves the end result of heating the interior 206 of the home or other structure 200 where the pellet stove 10 is installed. As the pellet fuel 12 burns in the burn basket 74, more pellet fuel 12 will fall, by gravity feed, into the burn basket 74 from the quantity of pellet fuel 13 in the pellet storage chamber 164 of the hopper 154. The user can adjust the amount of heat 220 produced by the pellet stove 10 by increasing or decreasing the amount of pellet fuel 12 that is allowed in the burn basket 74 by adjusting the fuel control mechanism 76 accordingly. The heating provided by the pellet stove 10 can be shut-off by operating the adjustment mechanism 188 to stop the gravity feed of pellet fuel 12 from the hopper 154 to the burn basket 74. When necessary, additional pellet fuel 12 can be added to the quantity of pellet fuel 13 in the pellet storage chamber 164 of the hopper 154 through the lid 160 thereof by disengaging the lid securing mechanism 178 and moving the lid 160 to its open position 174. After the pellet fuel 12 is added to the pellet storage chamber 164, the user will move the lid 160 to its closed position 172 and operate the lid securing mechanism 178 to engage the lid sealing mechanism 176 thereof and prevent exhaust air 130 from flowing into the interior 206 of the structure 200 through the hopper 154 when the pellet stove 10 is in use.

As will be readily appreciated by persons who are skilled in the art, the new gravity feed, natural draft pellet stove 10 of the present invention eliminates the need for electrically-driven blowers, augers and like devices to provide the combustion air (inlet air 130) for burning the pellet fuel 12 and to deliver the pellet fuel 12 to the primary burn chamber assembly 22. The new pellet stove 10 is specifically structured and arranged to efficiently and effectively burn pellet fuel 12 so as to achieve nearly complete combustion of the pellet fuel 12 in a manner which substantially reduces the amount of ash that needs to be disposed of and the amount of particulate or other harmful matter in the emissions exhausted from the pellet stove 12 as exhaust air 130 so the new pellet stove 10 will be able to be utilized for heating and cooking in a very cost effective and environmentally friendly manner. Because the new pellet stove 10 is sealed and only draws in inlet air from the outside of a structure 200 in which the pellet stove 10 is utilized and only directs exhaust air 130 to outside of the structure 200, the pellet stove 10 will prevent smoke spillage into the interior 206 of the structure 200 and not cause or contribute to negative air pressure in the interior 206 of the structure 200.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventors and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. A pellet stove for use in an interior of a structure, said pellet stove comprising:

a stove enclosure having one or more walls defining an interior area of said pellet stove;

a hopper assembly associated with the stove enclosure, said hopper assembly having a hopper with one or more hopper walls defining a pellet storage chamber for storing a quantity of pellet fuel therein, said hopper having a fuel discharge opening associated therewith for directing pellet fuel downward below said hopper, said hopper structured and arranged to gravity feed said pellet fuel from said pellet storage chamber through said fuel discharge opening;

a core assembly disposed inside said interior area of said stove enclosure, said core assembly having a burn chamber housing positioned below said fuel discharge opening of said hopper, a primary burn channel connected in fluid flow communication with said burn chamber, and a flame chamber connected in fluid flow communication with said primary burn channel so as to pneumatically connect said flame chamber to said burn chamber;

a primary burn chamber assembly associated with said burn chamber housing in said interior area of said stove enclosure for burning pellet fuel from said hopper, said primary burn chamber assembly having a primary burn chamber, a burn basket associated with said primary burn chamber and a fuel control mechanism operatively associated with said primary burn chamber and said burn basket, said burn basket sized and configured to receive the pellet fuel from said fuel discharge opening of said hopper, said fuel control mechanism structured and arranged to control the amount of pellet fuel received in said burn basket so as to control the amount of pellet fuel burned in said primary burn chamber assembly; and a venting system having an inlet tube associated with said stove enclosure to draw inlet air into said primary burn chamber assembly for combustion of the pellet fuel in said burn basket and discharges exhaust air from said flame chamber and out of said pellet stove through an exhaust tube associated with said stove enclosure, wherein said pellet stove is sealably configured such that after the pellet fuel is lit in said burn basket, the inlet air is drawn through said inlet tube to said burn basket to produce a fire therein which produces fire, heated air and the exhaust air from the burning pellet fuel that flows through said primary burn channel to said flame chamber to produce heat at said walls of said enclosure that heats the interior of the structure and to discharge the exhaust air out of said pellet stove through said exhaust tube without drawing inlet air from the interior of the structure or discharging exhaust air into the interior of the structure.

2. The pellet stove of claim 1 further comprising a hot plate associated with said flame chamber and a top wall of said stove enclosure, said hot plate positioned and configured to be heated by the fire and the heated air from said flame chamber so as to define a heating surface on said top wall of said stove enclosure for cooking food and/or heating liquids thereon.

3. The pellet stove of claim 2, wherein said hot plate is above said flame chamber and at least substantially adjacent said top wall of said stove enclosure.

4. The pellet stove of claim 1, wherein each of said burn basket and said fuel control mechanism are cooperatively structured and arranged to controllably receive and burn pellet fuel in said burn basket by adjusting the amount of pellet fuel held in said burn basket by operation of said fuel control mechanism.

5. The pellet stove of claim 4, wherein said primary burn chamber comprises a chamber support having a face plate attached thereto or integral therewith and said fuel control mechanism comprises a control lever and at least one notch on said face plate of said chamber support, said notch structured and arranged to be engaged by movement of said control lever so as to reduce or increase the capacity of said burn basket for holding pellet fuel.

6. The pellet stove of claim 5, wherein said face plate has a plurality of said notches on at least one edge of said face plate.

7. The pellet stove of claim 4, wherein said burn basket comprises a plurality of upwardly disposed generally U-shaped holding bars in spaced apart relation to each other so as to define a plurality of gaps between adjacent pairs of said holding bars and a pivot bar disposed through at least one of said gaps.

8. The pellet stove of claim 7, wherein said fuel control mechanism comprises a plurality of spaced apart control arms, a pivot rod connected to at least one of said control arms and a control lever connected to said pivot rod, said control arms moveably disposed in said gaps between said holding bars, said control arms having a proximal end connected to said pivot bar and a distal end pivotally connected to said pivot bar so as to allow said control arms to pivot relative to said holding bars to reduce or increase the capacity of said burn basket for holding pellet fuel.

9. The pellet stove of claim 4, wherein said fuel control mechanism comprises a control lever and a plurality of notches associated with said primary burn chamber, each one of said plurality of notches structured and arranged to be engaged by said control lever so as to prevent uncontrolled movement of said control lever, said fuel control mechanism operated by movement of said control lever and engagement thereof with one of said plurality of notches so as to reduce or increase the capacity of said burn basket for holding pellet fuel to control the amount of fuel that is burned in the primary burn chamber assembly.

10. The pellet stove of claim 9, wherein said plurality of notches are located on at least one edge of a face plate associated with a chamber support of said primary burn chamber.

11. The pellet stove of claim 4, wherein said burn basket is inside said primary burn chamber and said primary burn chamber has an aperture and a lighting tube extending outward from said primary burn chamber, said lighting tube open to said burn basket through said aperture and sized and configured for lighting the pellet fuel in said burn basket through a closeable opening in said stove enclosure.

12. The pellet stove of claim 1, wherein said core assembly is sized and configured to allow the flame from said burn basket to extend to said flame chamber and said stove enclosure has a glass panel associated with said flame chamber, said glass panel positioned on said stove enclosure and sized and configured to allow viewing of the fire in said flame chamber through said glass panel.

13. The pellet stove of claim 1 further comprising an inlet pipe that is sealably connected to or integral with said inlet tube to draw in the inlet air from outside the structure, an outlet pipe that is sealably connected to or integral with said exhaust tube to discharge the exhaust air from said pellet stove to outside the structure and a plurality of sealing mechanisms that are sized and configured to seal said pellet stove and to prevent the inlet air being drawn into the pellet stove from the interior of the structure and to prevent the exhaust air from said pellet stove being discharged to the interior of the structure.

14. A pellet stove for use in an interior of a structure, said pellet stove comprising:

a stove enclosure having one or more walls defining an interior area of said pellet stove, said stove enclosure having one or more doors associated therewith to allow access to said interior area from outside said stove enclosure;

a hopper assembly associated with the stove enclosure, said hopper assembly having a hopper with one or more hopper walls defining a pellet storage chamber for storing a quantity of pellet fuel therein, said hopper having a fuel discharge opening associated therewith for directing pellet fuel downward below said hopper, said hopper structured and arranged to gravity feed said pellet fuel from said pellet storage chamber through said fuel discharge opening;

a core assembly disposed inside said interior area of said stove enclosure, said core assembly having a burn chamber housing positioned below said fuel discharge opening of said hopper, a primary burn channel connected in fluid flow communication with said burn chamber, and a flame chamber connected in fluid flow communication with said primary burn channel so as to pneumatically connect said flame chamber to said burn chamber;

a hot plate associated with said flame chamber and a top wall of said stove enclosure, said hot plate positioned and configured to be heated by fire and heated air from said flame chamber and to define a heating surface on said top wall of said stove enclosure for cooking food and/or heating liquids thereon;

a primary burn chamber assembly associated with said burn chamber housing in said interior area of said pellet stove for burning pellet fuel from said hopper, said primary burn chamber assembly having a primary burn chamber, a burn basket associated with said primary burn chamber and a fuel control mechanism operatively associated with said primary burn chamber and said burn basket, said burn basket sized and configured to receive the pellet fuel from said hopper, said fuel control mechanism and said burn basket being cooperatively structured and arranged to control the amount of pellet fuel received in said burn basket so as to control the amount of pellet fuel burned in said primary burn chamber assembly; and a venting system having an inlet tube associated with said stove enclosure to draw inlet air into said primary burn chamber assembly from outside the structure through an inlet pipe sealably connected to or integral with said inlet tube for combustion of the pellet fuel in said burn basket and discharges exhaust air from said flame chamber and out of said pellet stove through an exhaust pipe sealably connected to or integral with an exhaust tube associated with said stove enclosure, wherein said pellet stove is sealably configured such that after the pellet fuel is lit in said burn basket, the inlet air is drawn from said inlet pipe through said inlet tube to said burn basket to produce a fire therein that produces the fire, the heated air and the exhaust air that flows from the burning pellet fuel in said burn basket through said primary burn channel to said flame chamber so as to produce heat at said walls of said enclosure that heats the interior of the structure and to discharge the exhaust air out of said pellet stove through said exhaust tube and the exhaust pipe without drawing inlet air from the interior of the structure or discharging exhaust air into the interior of the structure.

15. The pellet stove of claim 14, wherein said burn basket comprises a plurality of upwardly disposed generally U-shaped holding bars in spaced apart relation to each other so as to define a plurality of gaps between adjacent pairs of said holding bars and a pivot bar disposed through at least one of said gaps and said fuel control mechanism comprises a plurality of spaced apart control arms, a pivot rod connected to at least one of said control arms and a control lever connected to said pivot rod, said control arms moveably disposed in said gaps between said holding bars, said control arms having a proximal end connected to said pivot bar and a distal end pivotally connected to said pivot bar so as to allow said control arms to pivot relative to said holding bars to reduce or increase the capacity of said burn basket for holding pellet fuel.

16. The pellet stove of claim 14, wherein said fuel control mechanism comprises a control lever and a plurality of notches associated with said primary burn chamber, each one of said plurality of notches structured and arranged to be engaged by said control lever so as to prevent uncontrolled movement of said control lever, said fuel control mechanism operated by movement of said control lever and engagement thereof with one of said plurality of notches so as to reduce or increase the capacity of said burn basket for holding pellet fuel to control the amount of fuel that is burned in the primary burn chamber assembly.

17. The pellet stove of claim 16, wherein said plurality of notches are located on at least one edge of a face plate associated with a chamber support of said primary burn chamber.

18. A pellet stove for burning pellet fuel to produce heat for warming an interior of a structure and cooking, said pellet stove comprising:

a stove enclosure having one or more walls defining an interior area of said pellet stove, said stove enclosure having one or more doors associated therewith to allow access to said interior area from outside said stove enclosure, each of said doors configured to be sealably closed;

a hopper assembly associated with the stove enclosure, said hopper assembly having a hopper and a pellet chute below said hopper, said hopper having one or more hopper walls defining a pellet storage chamber for storing a quantity of pellet fuel therein and a shaped bottom section defining a fuel discharge opening for directing pellet fuel to said pellet chute positioned below said fuel discharge opening, said hopper and said pellet chute structured and arranged to gravity feed pellet fuel from said pellet storage chamber through said pellet chute;

an adjustment mechanism associated with one of said hopper and said pellet chute to control the amount of pellet fuel discharged from said quantity of pellet fuel through said fuel discharge opening;

a core assembly inside said interior area, said core assembly having a burn chamber housing positioned below said pellet chute, a flame chamber in spaced apart relation to said burn chamber housing and a primary burn channel interconnecting said burn chamber and said flame chamber in fluid flow communication so as to allow fire, heated air and exhaust air to flow from said burn chamber to said flame chamber;

a glass panel associated with said stove enclosure at said flame chamber, said glass panel sized and configured to allow viewing of the fire in said flame chamber;

a hot plate associated with said flame chamber and a top wall of said stove enclosure, said hot plate positioned and configured to be heated by the fire and the heated air in said flame chamber and to define a heating surface on said top wall of said stove enclosure for cooking food and/or heating liquids thereon;

a primary burn chamber assembly disposed in said interior area of said pellet stove and associated with said burn chamber housing of said core assembly, said primary burn chamber assembly having a primary burn chamber, a burn basket supported by said primary burn chamber for receiving and burning the pellet fuel from said pellet chute, and a fuel control mechanism for controlling the amount of the pellet fuel received in said burn basket from said so as to control the amount of the pellet fuel burned in said primary burn chamber assembly; and a venting system having an inlet tube associated with said stove enclosure to draw inlet air into said primary burn chamber assembly from outside the structure through an inlet pipe sealably connected to or integral with said inlet tube for combustion of the pellet fuel in said burn basket and discharges exhaust air from said flame chamber and out of said pellet stove through an exhaust pipe sealably connected to or integral with an exhaust tube associated with said stove enclosure, wherein said pellet stove is sealably configured such that after the pellet fuel is lit in said burn basket, the inlet air is drawn from said inlet pipe and through said inlet tube to said burn basket to produce a fire therein that produces the fire, the heated air and the exhaust air that flows from the burning pellet fuel in said burn basket through said primary burn channel to said flame chamber so as to produce heat at said walls of said enclosure that heats the interior of the structure and to discharge the exhaust air out of said pellet stove through said exhaust tube and said exhaust pipe without drawing inlet air from the interior of the structure or discharging exhaust air into the interior of the structure.

19. The pellet stove of claim 18, wherein said burn basket comprises a plurality of upwardly disposed generally U-shaped holding bars in spaced apart relation to each other so as to define a plurality of gaps between adjacent pairs of said holding bars and a pivot bar disposed through at least one of said gaps and said fuel control mechanism comprises a plurality of spaced apart control arms, a pivot rod connected to at least one of said control arms and a control lever connected to said pivot rod, said control arms moveably disposed in said gaps between said holding bars, said control arms having a proximal end connected to said pivot bar and a distal end pivotally connected to said pivot bar so as to allow said control arms to pivot relative to said holding bars to reduce or increase the capacity of said burn basket for holding pellet fuel.

20. The pellet stove of claim 18, wherein said fuel control mechanism comprises a control lever and a plurality of notches on at least one edge of a face plate of a chamber support of said primary burn chamber, each one of said plurality of notches structured and arranged to be engaged by said control lever so as to prevent uncontrolled movement of said control lever, said fuel control mechanism operated by movement of said control lever and engagement thereof with one of said plurality of notches so as to reduce or increase the capacity of said burn basket for holding pellet fuel to control the amount of fuel that is burned in the primary burn chamber assembly.

* * * * *